US005755619A

United States Patent [19]

Matsumoto et al.

[11] Patent Number: 5,755,619

[45] Date of Patent: May 26, 1998

[54] BINGO GAME MACHINE

[75] Inventors: Kusuo Matsumoto, Akikawa; Shiro Majima, Zama, both of Japan

[73] Assignee: Konami Co., Ltd., Hyogo-ken, Japan

[21] Appl. No.: 529,841

[22] Filed: Sep. 18, 1995

[30] Foreign Application Priority Data

Sep. 20, 1994 [JP] Japan ..... 6-225358

[51] Int. Cl.[6] ..... A63F 3/06

[52] U.S. Cl. ..... 463/19; 463/18; 273/269

[58] Field of Search ..... 273/138.2, 269; 463/19, 18, 17

[56] References Cited

U.S. PATENT DOCUMENTS

| | | | |
|---|---|---|---|
| 4,087,092 | 5/1978 | Krause et al. | 273/138.2 |
| 4,206,920 | 6/1980 | Weatherford et al. | 273/138.2 |
| 4,254,404 | 3/1981 | White | 340/311 |
| 4,365,810 | 12/1982 | Richardson | 273/237 |
| 4,475,157 | 10/1984 | Bolan | 273/269 |
| 4,798,387 | 1/1989 | Richardson | 273/237 |
| 4,856,787 | 8/1989 | Itkis | 273/237 |
| 5,192,076 | 3/1993 | Komori | 273/138.2 |

FOREIGN PATENT DOCUMENTS

| | | | |
|---|---|---|---|
| 671010 | 3/1994 | Japan | 273/269 |
| 2105996 | 4/1983 | United Kingdom | 273/269 |

*Primary Examiner*—Benjamin H. Layno
*Attorney, Agent, or Firm*—Jordan and Hamburg

[57] ABSTRACT

A bingo game machine, in which a plurality of randomly selected special signs are compared with signs on a bingo card and a winner of a game is decided in accordance with correspondence of the signs, includes: a display unit which displays a bingo card image including squares arranged in a matrix and allotted with different signs; and a changer which changes the sign in a predetermined square of the bingo card image.

15 Claims, 30 Drawing Sheets

BINGO GAME MACHINE

BACKGROUND OF THE INVENTION

This invention relates to a bingo game machine which compares signs on a bingo card displayed in a display unit with a plurality of randomly selected special signs and decides the winner of the game based on the correspondence of the signs.

There is known a bingo game machine including a juggling box in which a plurality of balls are juggled. The bingo game machine receives the juggled balls one by one and detects the numbers on the received balls. A bingo card in which specified numbers are randomly arranged is displayed on a game display for each game player. If the detected numbers on the balls corresponding with the numbers on the bingo card cover numbers in a line of the bingo card, the player having this bingo card wins the game and tokens are paid to him. Such a bingo game machine is displayed in Japanese Unexamined Patent Publication No. 6-71010.

In the above machine, the line bingo card is displayed on the game display, and the same numbers as the detected numbers on the balls are displayed on the bingo card as valid numbers. If the valid numbers cover one line on the bingo card, the player wins and the winnings are paid to him. However, this bingo game is merely such that the bingo card including randomly arranged numbers is displayed and the game is played in accordance with the rules only for the line bingo. The player is allowed to select his/her desired bingo card out of a plurality of quite different bingo cards. Quite a few bingo cards need to be prepared in order to allow the player to select his/her desired one. This leads to an increase in a storage capacity. Further, there is little difference between this bingo game and the one conducted using paper bingo cards. Accordingly, the bingo game machine is not provided with special functions as an electric game machine. Thus, the machine is not interesting enough for the players.

SUMMARY OF THE INVENTION

It is an object of the present invention to provide a bingo game machine which has overcome the problems residing in the prior art.

It is another object of the present invention to provide a bingo game machine which makes it possible to give small changes to signs in squares of a bingo card and to divided areas of a bingo card to thereby make a bingo game more enjoyable and unpredictable.

It is yet another object of the present invention to provide a bingo game machine which makes it possible to select one game out of a plurality of kinds of games using only one display screen and display a special card corresponding to a selected game so that players enjoy a variety of games.

Accordingly, the present invention is directed to a bingo game machine in which a plurality of randomly selected special signs are compared with signs on a bingo card and a winner of a game is decided in accordance with correspondence of the signs, comprising: a display unit which displays a bingo card image including squares arranged in a matrix and allotted with different signs; and a changer which changes the sign in a predetermined square of the bingo card image.

The changer may be constructed by: a shifting device which shifts signs allotted in the squares one line of at least one column or one row of the bingo card image displayed in the display unit; and an allotting device which allots signs different from the signs which have not erased in the shift in squares of a new line which is produced in the shift.

The allotting device may be made to allot the signs which has been erased in the shift in squares of a new line.

The shifting device may be operable until a specified number of special signs are selected out of the plurality of special signs. Also, the shifting device may be constructed by: a mark displaying device which displays a shift designation mark on the display unit; and a touch sensor which is provided on the display unit in connection with the shift designation mark and adapted to activate the line shift in accordance with a player's touch.

Further, the changer may be constructed by: a memory which stores at least either a plurality of sign allotting patterns of allotting signs in the squares of the bingo card image or a plurality of separating patterns of separating the squares of the bingo card image into two or more separation areas; and a changing device which changes at least either the sign allotting pattern or the separating pattern for each game. The separation areas may be defined on the display unit by different colors.

Furthermore, the changer may be constructed by: a first changer device having: a shifting device which shifts signs allotted in the squares one line of at least one column or one row of the bingo card image displayed in the display unit; and an allotting device which allots signs different from the signs which have not erased in the shift in squares of a new line which is produced in the shift; a second changer device having: a memory which stores at least either a plurality of sign allotting patterns of allotting signs in the squares of the bingo card image or a plurality of separating patterns of separating the squares of the bingo card image into two or more separation areas; and a changing device which changes at least either the sign allotting pattern or the separating pattern for each game; and a selector which changes over the first changer device and the second changer device.

Moreover, the bingo game machine may be provided with a counter which counts the number of special signs selected up to a current time; and a count value displaying device which displays a value counted by the counter.

With thus constructed bingo game machine, there is provided the changer for changing a sign in a predetermined square of the bingo card image. Accordingly, a variety of bingo cards can be produced easily, thereby providing players with more enjoyable and unpredictably games.

The shifting device enables shifting of one line of squares either in the column direction or the row direction. Different signs or erased signs allotted in a new line of squares. Accordingly, the bingo card can be changed by one column or one row to provide an increased number of games.

Also, the shift is operated until a specified number of special signs are selected out of the plurality of special signs. The player can obtain an arrangement of the signs on the bingo card which is advantageous to him by shifting the line(s) in desired direction(s) while viewing the positions of the already corresponded signs on the bingo card.

Further, the shifting device is provided with the mark displaying device and the touch sensor. The player can shift squares of the bingo card easily by touching the touch sensor while seeing the mark.

Alternatively, the changer is provided with the memory storing a plurality of sign allotting patterns and a plurality of separating patterns. At least one of the sign allotting pattern and the separating pattern is changed by the changing device. Accordingly, the bingo card can be changed into a variety of patterns with ease, which will thus ensure more enjoyable game. Also, the separation areas are defined by different colors. This will give the player clearer separation.

In the case of the changer including the selector which changes over the first changer device carrying out the line shift and the second changer device carrying out the pattern change, the bingo card can be changed in more variety. Accordingly, the player can enjoy more unpredictable and selectable games.

Moreover, the counter is provided to count the number of special signs selected up to a current time and a counted value is then displayed. Accordingly, the player can easily grasp the present stage of the game.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
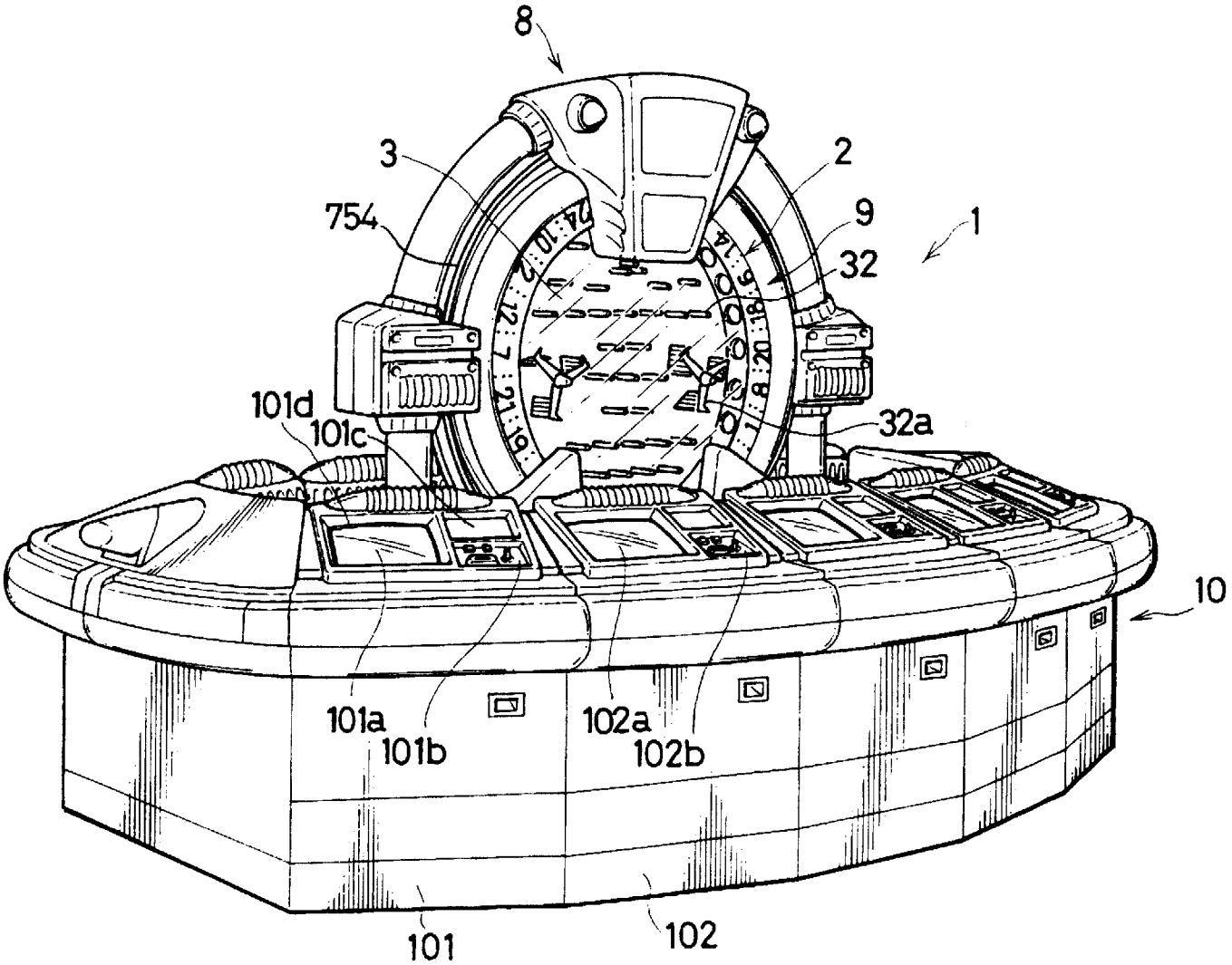
FIG. 1 is a perspective view showing an exterior of a bingo game machine according to the invention.

FIG. 1 is a perspective view showing an exterior of a bingo game machine according to the invention. The bingo game machine includes a machine unit 1 in the middle and an operation/display unit 10 arranged around the machine unit 1. The construction of the game machine on its front and rear sides are identical.

The operation/display unit 10 has a plurality of game terminals 101, 102, . . . symmetrically arranged on the front and rear sides of the game machine. Since the respective game terminal have the same construction, description is given to the construction of only the game terminal 101. On the upper surface of the terminal 101, there are arranged a display 101*a* and a panel 101*b* next to each other. The display 101*a* includes a CRT (cathode ray tube) or a LCD (liquid crystal display) for displaying contents of games and an operation menu. The panel 101*b* includes a token inlet, an indicator for indicating the number of remaining tokens, and a reset button. A pay-back token outlet 101*c* is formed above the panel 101*b* of the terminal 101. When a player wins, a specified number of tokens are paid to him/her according to the result of the game. The game machine is provided internally with an unillustrated token pay-back unit (see FIG. 20) for taking the specified number of tokens according to the result of the game from a token storage unit while counting them by means of a token counter or the like.

In this game machine, the display 101*a* is adapted to electronically display a bingo card and the like and to display a variety of inputs and instructions necessary to play a game in a menu table so that a game participant can easily understand them. A transparent touch panel 101*d* is placed over the surface of the display 101*a* so as to allow the game participant to have direct access to the display menu table.

The touch panel 101*d* is a two-dimensional plate member which extends in an X-Y plane and is made of material capable of propagating ultrasonic waves. The touch panel 101*d* includes an ultrasonic wave generator disposed along each axis at an end thereof, and a device for repeatedly transmitting the generated ultrasonic wave toward the opposite end of each axis in a high cycle. When the player presses a desired position of the plate member with his finger or the like, the transmitted ultrasonic wave is reflected in the pressed position and travels back to the generator. Taking advantage of this, the pressed position (X, Y) is calculated by measuring a time which lasts until the ultrasonic wave reaches the generator after being generated. The menu item corresponding to the pressed position is discriminated based on a correspondence between coordinates of the touch panel 101*d* and coordinates of the menu items on the display surface which is defined in advance.

Figure 2:
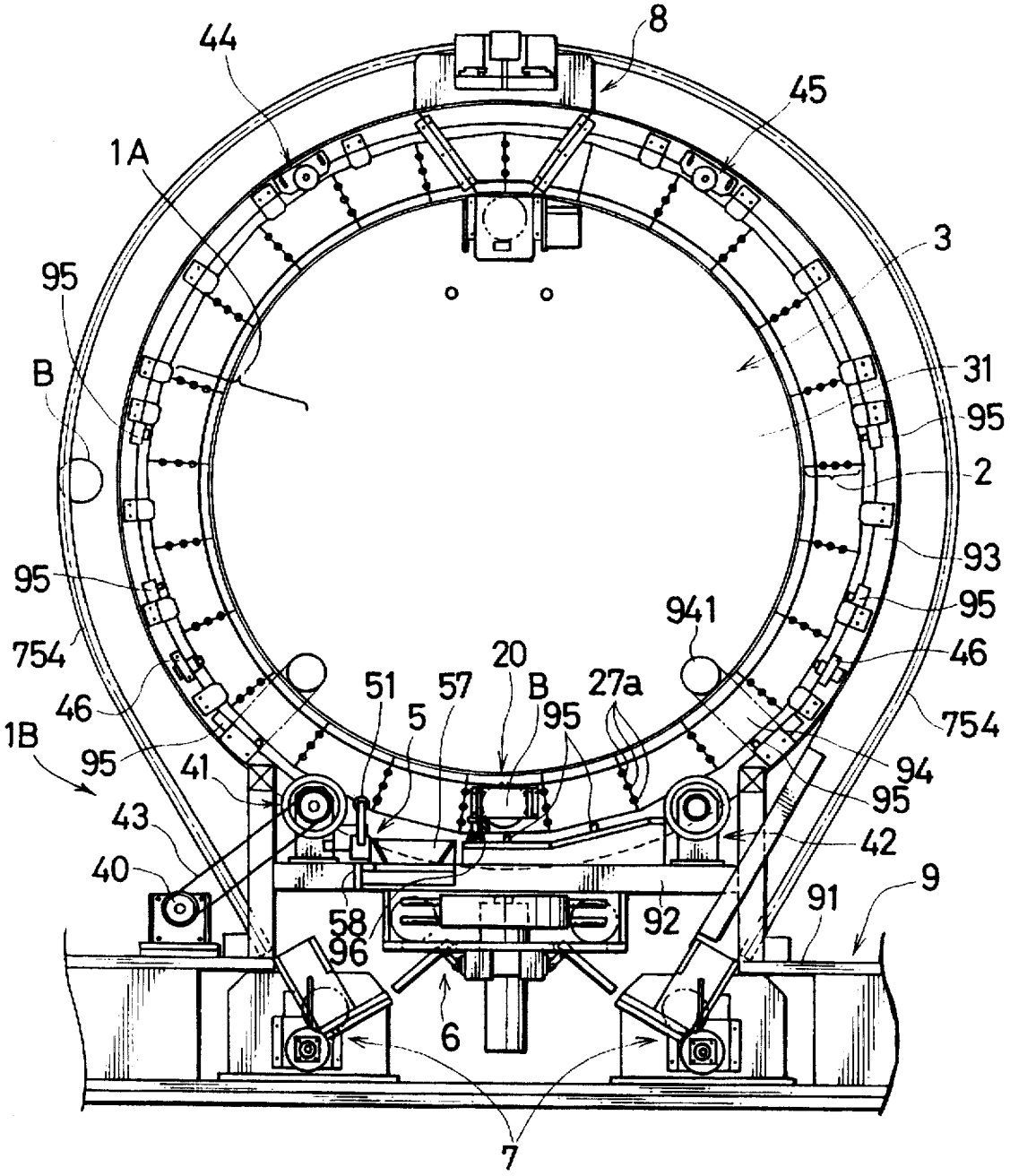
FIG. 2 is a front view showing a schematic construction of a machine unit of the bingo game machine.

FIG. 2 is a front view showing a schematic construction of the machine unit 1.

The machine unit 1 includes a roulette unit 1A and a ball feeding unit 1B which stand on a support 9.

The roulette unit 1A is provided with a rotary wheel 2 including a plurality of ball containers 20 arranged in a circular manner to catch a ball B in a desired circumferential position, a fixed disk 3 disposed inside the rotary wheel 2, and a rotating mechanism 4 (see FIG. 3) for rotating the rotary wheel 2.

The ball feeding unit 1B is provided with a collecting mechanism 5 for collecting the balls B from the rotary wheel 2 after the game is over, a supply device 6 for supplying the balls B one by one during the game, shooting devices 7 for shooting the ball B supplied from the supply device 6 upward, and a guide device 8 for guiding the shot ball B into the fixed disk 3 at an upper part of the roulette unit 1A.

An overall operation of the machine unit 1 is summarily described so that one can easily understand the construction of the machine unit 1.

Upon the start of a game, the balls B are hit one by one by the shooting devices 7 and are led to the guide device 8. The ball B is guided by the guide device 8 to enter the fixed disk 3, and is led to the rotary wheel 2 while irregularly falling down in the fixed disk 3. Finally, the ball B is caught in one of the ball containers 20 of the rotary wheel 2. The above operation is successively performed for a specified number of balls, e.g., 10 balls. Each time the ball B is caught by the ball container 20, a special sign affixed to this ball container 20 is output, and the game develops while the special signs are obtained in this way. After the same operation is performed for 10 balls, the first game ends. Upon the completion of the game, the collecting mechanism 5 collects the 10 caught balls one after another and stores them in the supply device 6. Then, the game machine enters a standby state. Upon the start of a next game, the balls B are supplied one by one from the supply device 6 to the shooting devices 7, and are shot by the shooting devices 7.

Figure 3:
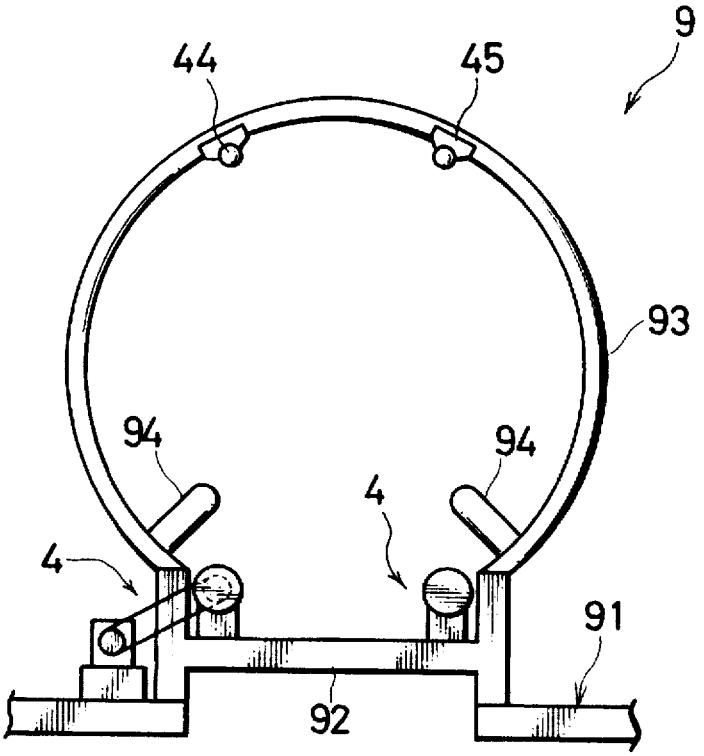
FIG. 3 is a front view showing a structure of a support provided in the machine unit.

The construction of the support 9 is described with reference to FIGS. 2 and 3. FIG. 3 is a front view of the support 9 provided in the machine unit 1.

The support 9 includes a base 91, a support arm 92 extending in a lateral direction on the base 91, and a support wheel 93 which is integrally connected with the support arm 92 so as to extend upward from the opposite lateral ends of the support arm 92. The support wheel 93 is made of a pipe having a rectangular cross section, and has a specified diameter (e.g. about 1 m). The roulette unit 1A is mounted inside the support wheel 93 and the ball feeding unit 1B is mounted outside it. The support wheel 93 is not formed along the support arm 92. The collecting mechanism 5, the supply device 6 and the shooting devices 7, to be described in detail later, are disposed along the support arm 92.

The construction of the fixed disk 3 is described with reference to FIGS. 1 and 2. The fixed disk 3 is formed by two circular transparent or semitransparent plates 31 of acrylic material which are spaced apart in parallel by a specified distance. The spacing between the plates 31 is set slightly larger than the diameter of the ball B so that the ball B can smoothly fall down between the plates 31. Connecting pins 32 are mounted between the two plates 31 in a plurality of positions so as to hold and connect the plates 31 in parallel. For example, pinwheels 32*a* may be rotatably mounted on suitable ones of the connecting pins 32 as shown in FIG. 1. Upon randomly striking against the connecting pins 32 and the pinwheels 32*a*, the ball B down between the plates 31 and undergoes an irregular change of direction, thereby ensuring and demonstrating the randomness of the game.

Figure 16:
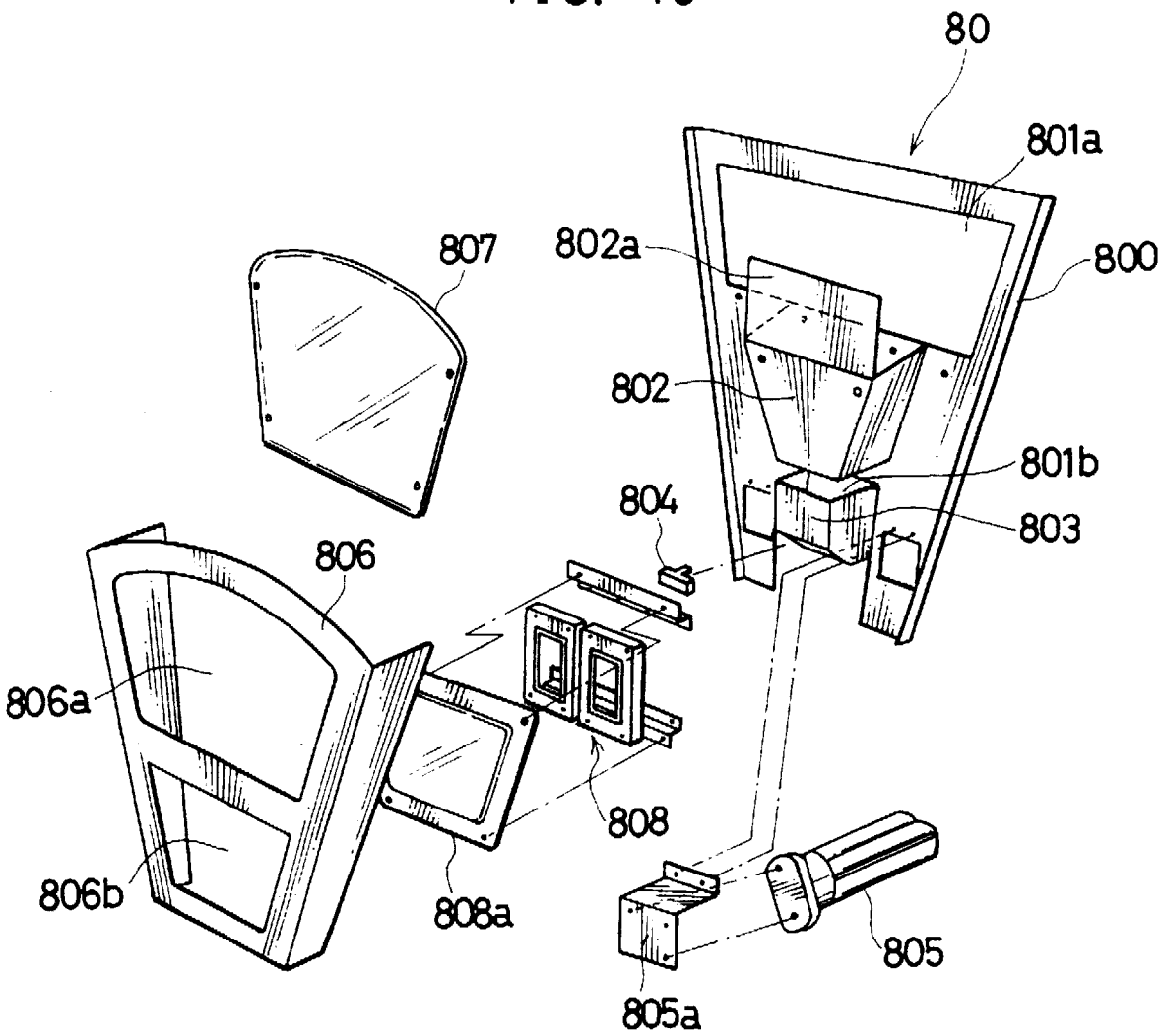
FIG. 16 is an exploded perspective view showing a structure of a chute of a guide device.

The plates 31 are supported upright by a pair of laterally disposed fixing arm members 94 extending from suitable positions on the support wheel 93. Each fixing arm member 94 includes two front and rear plate-like arms which extend along the outer surfaces of the corresponding plates 31. Each arm has, at its leading end, a mount member 941 which is connected with the corresponding plate 31 by means of a screw or adhesive. The plates 31 are also secured on a frame of the guide device 8 by a screw, or the like, so that they can be supported with a sufficient strength. More specifically, a pair of holes are formed at a lower part of a vertical base plate 800 as shown in FIG. 16. Shafts are mounted in these holes and holes formed in corresponding positions of upper parts of the plates 31 to securely hold the plates 31.

Figure 4:
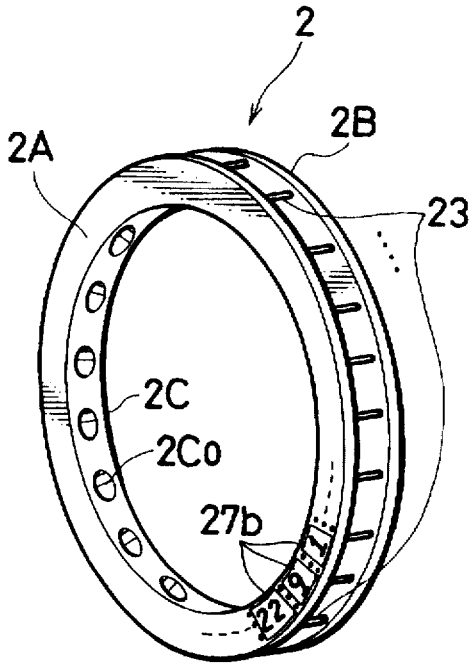
FIG. 4 is a schematic perspective view of a rotary wheel provided in the machine unit.

The construction of the rotary wheel is described with reference to FIGS. 2, 4 to 6. FIG. 4 is a schematic perspective view of the rotary wheel 2, FIG. 5 is an exploded perspective view of the ball container 20 of the rotary wheel 2, and FIG. 6 is a rear view of the ball container 20.

The rotary wheel 2 is disposed between the support wheel 93 and the fixed disk 3 as shown in FIG. 2. The rotary wheel 2 consists essentially of a frame including two parallel ring plates 2A and 2B and an inner plate 2C mounted between the inner peripheries of the ring plates 2A and 2B, and the ball containers 20 arranged in a circular manner in the frame. The rotary wheel 2 is rotated on a vertical plate by the rotating mechanism 4 to be described later. In this embodiment, there are arranged 25 ball containers 20 so as to correspond to the number of squares on the bingo card (5(row)×5(column)). Two stays 23 radially extend at opposite circumferential ends where each ball container 20 is arranged. Further, a circular inlet 2Co having a diameter slightly larger than that of the ball B is formed in the inner plate 2C in a position corresponding to the arrangement position of each ball container 20. As shown in FIG. 2, three LEDs 27*a* are arranged in a radial direction on the surface of each of the ring plates 2A and 2B in a position corresponding to each of the opposite circumferential ends of each ball container 20.

Figure 5:
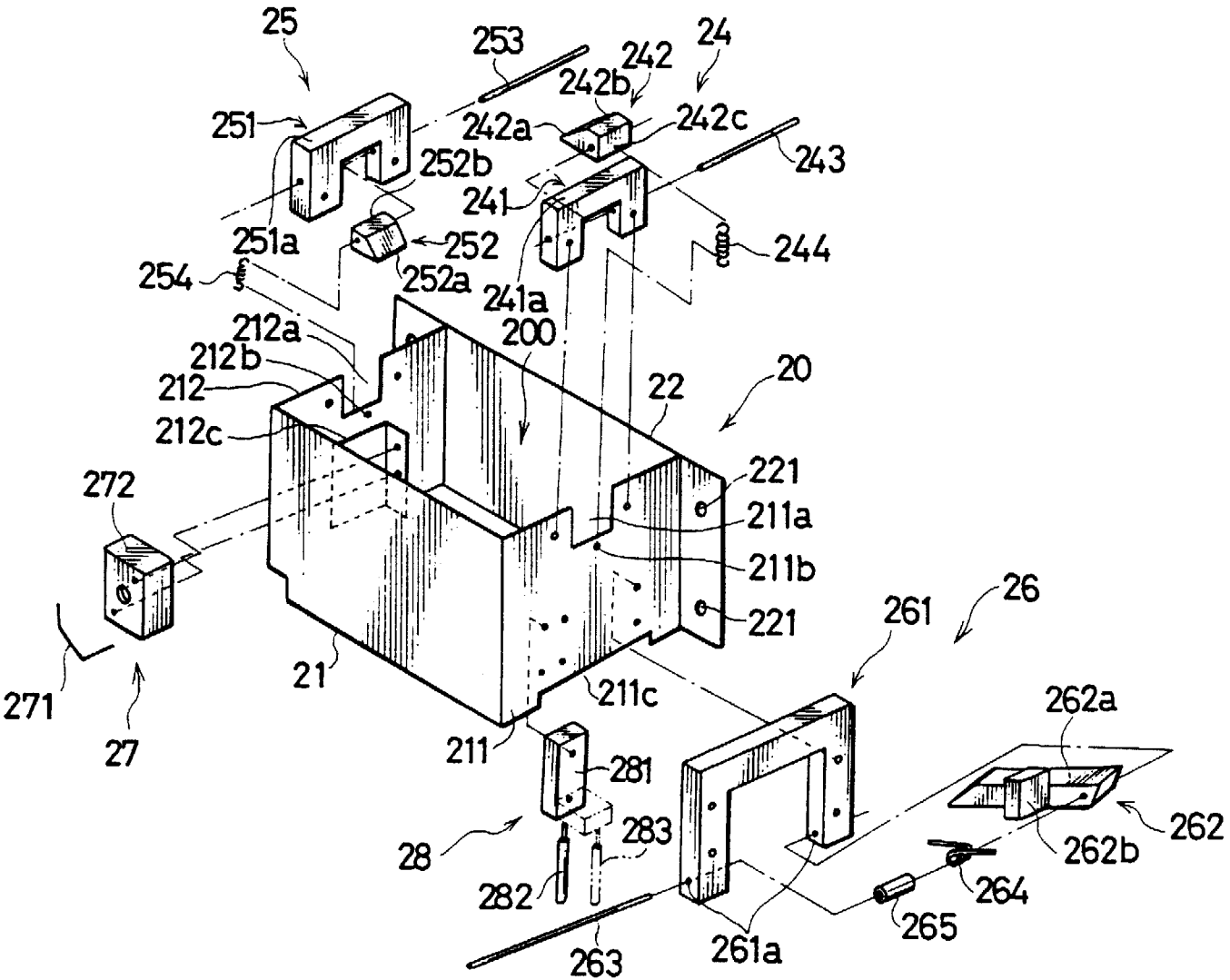
FIG. 5 is an exploded perspective view showing a ball container provided in the rotary wheel.
Figure 6:
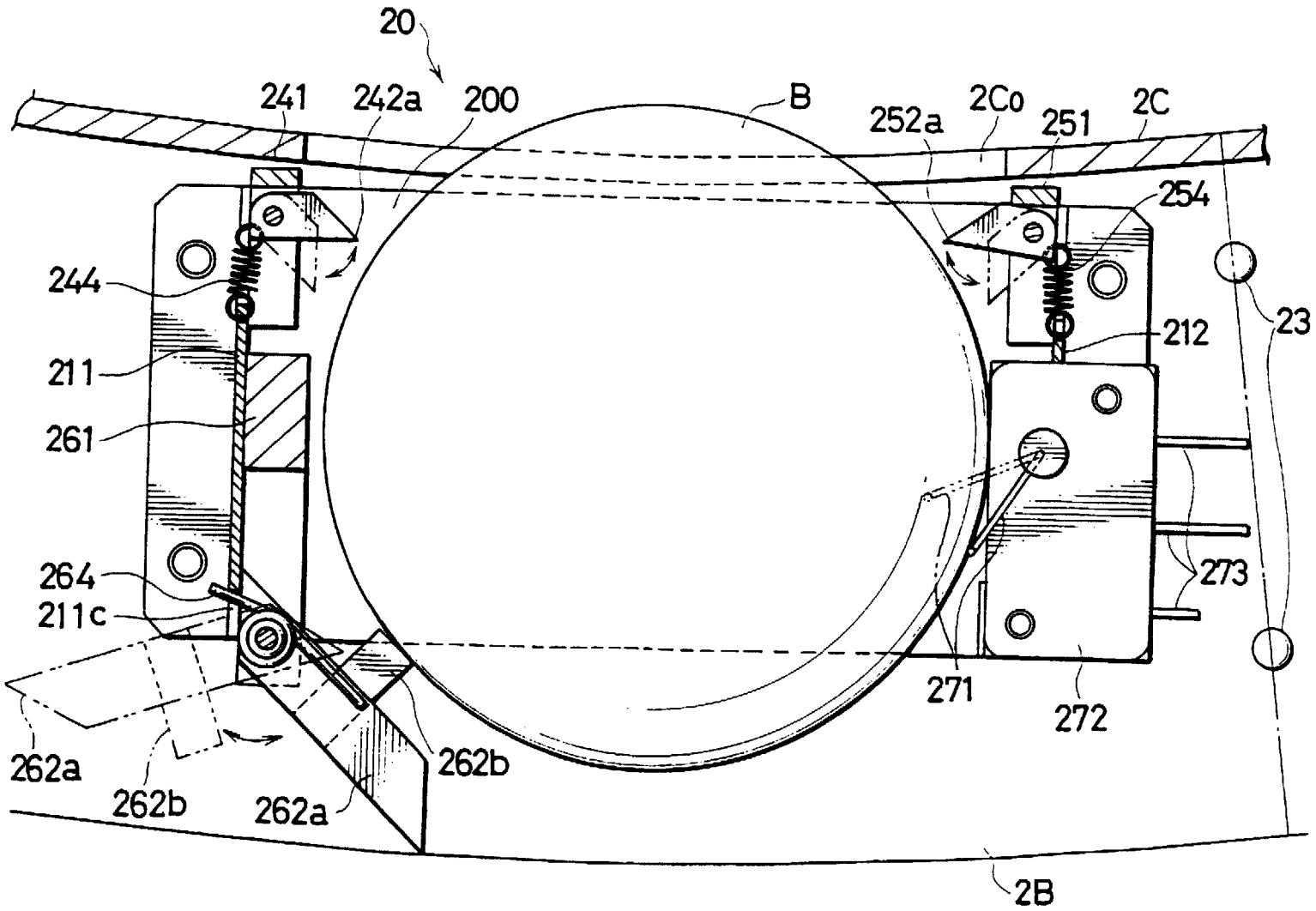
FIG. 6 is a rear view of the ball container.

The ball container 20, as shown in FIG. 5, consists essentially of a front plate 21 having a U-shaped cross section, and a flat rear plate 22 connected with the front plate 21. The ball container 20 is secured by means of a mount hole formed in the ring plate 2A. A ball accommodating space 200 is defined by the plates 21 and 22.

The front plate 21 includes side plates 211 and 212. A rectangular notch 211*a* is formed in a substantially upper middle part of the side plate 211, and a hook hole 211*b* is formed below the center of the notch 211*a*. Further, a shallow notch 211*c* is formed at the bottom of the side plate 211. On the other hand, the side plate 212 is formed with a notch 212*a* and a hook hole 212*b* in positions corresponding to those of the side plate 211. Further, a switch mount opening 212*c* is formed right below the notch 212*a*.

Identified by 24 and 25 are inlet locking members for preventing the ball B accommodated in the space 200 from coming out of the space 200. The inlet locking members 24, 25 are provided because the inlet of the ball container 20 faces downward while the rotary wheel 2 rotates in the vertical plane. The inlet locking member 24 includes a U-shaped arm member 241 having two opposite arms, a claw member 242 rotatably mounted between the two arms of the arm member 241, a shaft 243 for rotatably supporting the claw member 242 with respect to the arm member 241, and a spring 244 for biasing the claw member 242 toward its closed position. The arm member 241 is mounted to surround the notch 211*a* which acts as a space for permitting the claw member 242 to rotate. The claw member 242 is rotatably mounted between the two opposite arms of the member 241 such that its claw 242*a* projects into the ball accommodating space 200.

At this time, a ceiling 242*b* of the claw member 242 comes into contact with an intermediate arm 241*a* of the arm member 241, with the result that the claw member 242 cannot rotate any further than a position indicated by solid line in FIG. 6. Further, the claw member 242 is biased toward a position where the claw member 242 closes the ball accommodating space 200 (a position where the ceiling 242*b* of the claw member 242 is in contact with the intermediate arm 241*a* of the arm member 241) by the spring 244 mounted between a mount hole 242*c* formed in the middle of a rear surface of the claw member 242 and the mount hole 211*b*. If the biasing force of the spring 244 is set such that, upon being struck by the ball B from the fixed disk 3, the claw member 242 rotates toward the space 200 due to the momentum of the ball B, the ball B is suitably guided into the ball container 20 and locked therein. Likewise, the inlet locking member 25 is mounted on the plate 212.

With the ball container 20 constructed as above, the ball B from the fixed disk 3 is guided to the ball accommodating space 200 and locked therein. Accordingly, even when the inlet of the ball container 20 faces downward as the rotary wheel 2 rotates in the vertical plane, the ball B in the ball container 20 will not come out due to its weight.

In the switch mount hole 212*c*, there is mounted an electric accessory switch 27 which has a movable portion 271 facing the ball accommodating space 200 and wiring terminals 273 projecting outward. When the surface of the ball B accommodated in the space 200 presses and shifts the movable portion 271 as shown in FIG. 6 (from a phantom line position to a solid line position), EL plates 27*b* (see FIG. 4), which are arranged at the opposite circumferential sides of the ball container 20 to light the numbers, to emit light when it is sensed that the ball B is accommodated in the ball container 20. It should be appreciated that the LEDs 27*a* are turned on as electric accessories when the game machine is powered.

The panels (EL plates) 27*b* of electroluminescent material, which have signs such as numbers in correspondence with the ball containers 20, are adhered to the surfaces of the ring plates 2A and 2B. By causing the EL plate 27*b* of the ball container 20 which has caught the ball B to emit light of a specified color, the ball catching position is made known, and the game participants tend to find the game more esthetic. In the case where the signs on the EL plates 27*b* of the respective ball containers 20 are numbers, numbers of 1 to 25 are arranged regularly, randomly, or in accordance with a specified roulette sequence.

An outlet locking member 26 includes a U-shaped arm member 261 having two opposite arms, a claw member 262 rotatably mounted between the two opposite arms of the arm member 261, a shaft 263 for rotatably supporting the claw member 262 with respect to the arm member 261, and a coil spring 264 for biasing the claw member 262 toward its closed position. The arm member 261 is mounted on the inner surface of the side plate 211 by screws so that the two opposite arms thereof straddle over the notch 211*c*. The arm member 261 has mount holes 261*a* formed at the lower ends of the opposite arms thereof. The shaft 263 inserted through the claw member 262, the coil spring 264 and a position restricting cylinder 265 are mounted between the mount holes 261*a*. The claw member 262 includes a pivotal portion 262*a* through which the shaft 263 is inserted, and a contact portion 262*b* perpendicularly extending from an intermediate position of the pivotal portion 262*a*. The coil spring 264 has one end thereof engaged with the notch 211*c* of the side plate 211, thereby biasing the contact portion 262*a* to face the ball accommodating space 200. When the ball B is accommodated, the contact portion 262*b* comes into contact with the surface of the ball B as shown in FIG. 6, thereby preventing the ball B coming out through the outlet of the ball container 20. The ball B accommodated in the space 200 is retained therein by the inlet locking members 24, 25 and the outlet locking member 26.

A detecting member 28 is provided in each of 25 ball containers 20 to detect a rotational position of the rotary wheel 2, and includes a mount 281 and a detecting portion 282 secured on the mount 281. The mount 281 is mounted in a suitable position on the inner surface of the side plate 211 (a position where the mount 281 does not interfere a ball sensor 95 to be described later), preferably in a position shifted in the forward/backward direction, so that the detecting portion 282 projects toward the outlet, i.e. outward with respect to a trace of rotation of the rotary wheel 2. A detecting member 28 having a construction as indicated by broken line is mounted on one ball container 20 as a reference of 25 ball containers. In other words, in addition to the detecting portion 282, the reference ball container 20 has a reference detecting portion 283 which is spaced apart from the detecting portion 282 in the rotating direction by a small distance.

A construction for detecting the presence of the ball B in the ball container 20 is provided in the support 9. More specifically, as shown in FIG. 2, one or more ball sensors 95 are disposed to face inward in suitable positions of the inner surface of the support wheel 93 of the support 9. In this embodiment, the catching position of the ball B is supposed to be, most of the time, located in the lower half of the roulette unit 1A. Accordingly, ball sensors 95 are suitably spaced apart in the circumferential direction in a relatively wide part of the support wheel 93 except its upper part. Specifically, 8 ball sensors 95 are spaced apart from a reference position sensor 96 to be described later by distances which are a multiple of a predetermined circumferential dimension of the ball container 20. The ball sensor 95 is a reflection type photosensor. Upon the receipt of the light reflected by the ball B caught in the ball container 20, the ball sensor 95 detects that the ball has been caught. The more parallel the surface of the ball B is, the higher level reflected light the ball sensor 95 can receive and the more the detection accuracy improves. Thus, the ball sensor 95 is directed at a substantially center position of the ball accommodating space 200.

In the support 9 right below the rotary wheel 2, the reference position sensor 96 is placed and include two photosensors, each of which is spaced in the circumferential direction by a small distance corresponding to a spacing between the detecting portions 282 and 283. The sensor 96 detects a timing at which the reference rotational position of the rotary wheel 2 passes the bottommost position (reference position detection) upon the receipt of two photosensor signals which are obtained when the detecting portions 282 and 283 pass the clearances between light emitting elements and light receiving elements of the two photosensors. One photosensor of the reference position sensor 96 also detects the detecting portions 282 of the ball containers 20 other than a reference ball container 20 (relative position detection). The sensor 96 needs not be located in the bottommost position, but may be located in any specified circumferential position of the rotary wheel 2. Further, the sensor 96 may not be a proximity switch such as a photosensor, but may be a mechanical switch which comes into contact with the detecting portion 282.

The presence of the ball B in each ball container 20 is detected as follows. The reference rotational position of the rotary wheel 2 is detected by the reference position sensor 96, and the detecting portions 282 of the respective ball containers 20 are detected by one of the photosensors of the reference position sensor 96 as the rotary wheel 2 rotates. Accordingly, a rotational phase of the rotary wheel 2 (i.e. which ball container 20 faces the reference position sensor 96) can be known. Since the ball containers 20 and the respective ball sensors 95 face in each rotational phase are known, whether or not the ball B is accommodated in the ball containers 20 facing the ball sensors 95 can be known by detecting the state of the respective ball sensors 95. In this case, the detection result of each of 8 ball sensors 95 for the ball containers 20 downstream from the ball sensor(s) 95 upstream therefrom with respect to the rotating direction of the rotary wheel 2 are used, and the detection results for the ball containers outside the above-defined area are ignored so as to avoid overlapping with the detections by the other ball sensors.

If there is at least one ball sensor 95, it is possible to detect the ball container 20 in which the ball B is accommodated. However, if a plurality of ball sensors are arranged in spaced-apart positions and make a detection for the ball containers 20 downstream from the ball sensor 95 upstream therefrom with respect to the rotating direction as in this embodiment, the detection of which ball container 20 the ball B has been accommodated in can be made faster. Accordingly, the sign discrimination and the game development based on the discrimination result can be made more smoothly.

Figure 7:
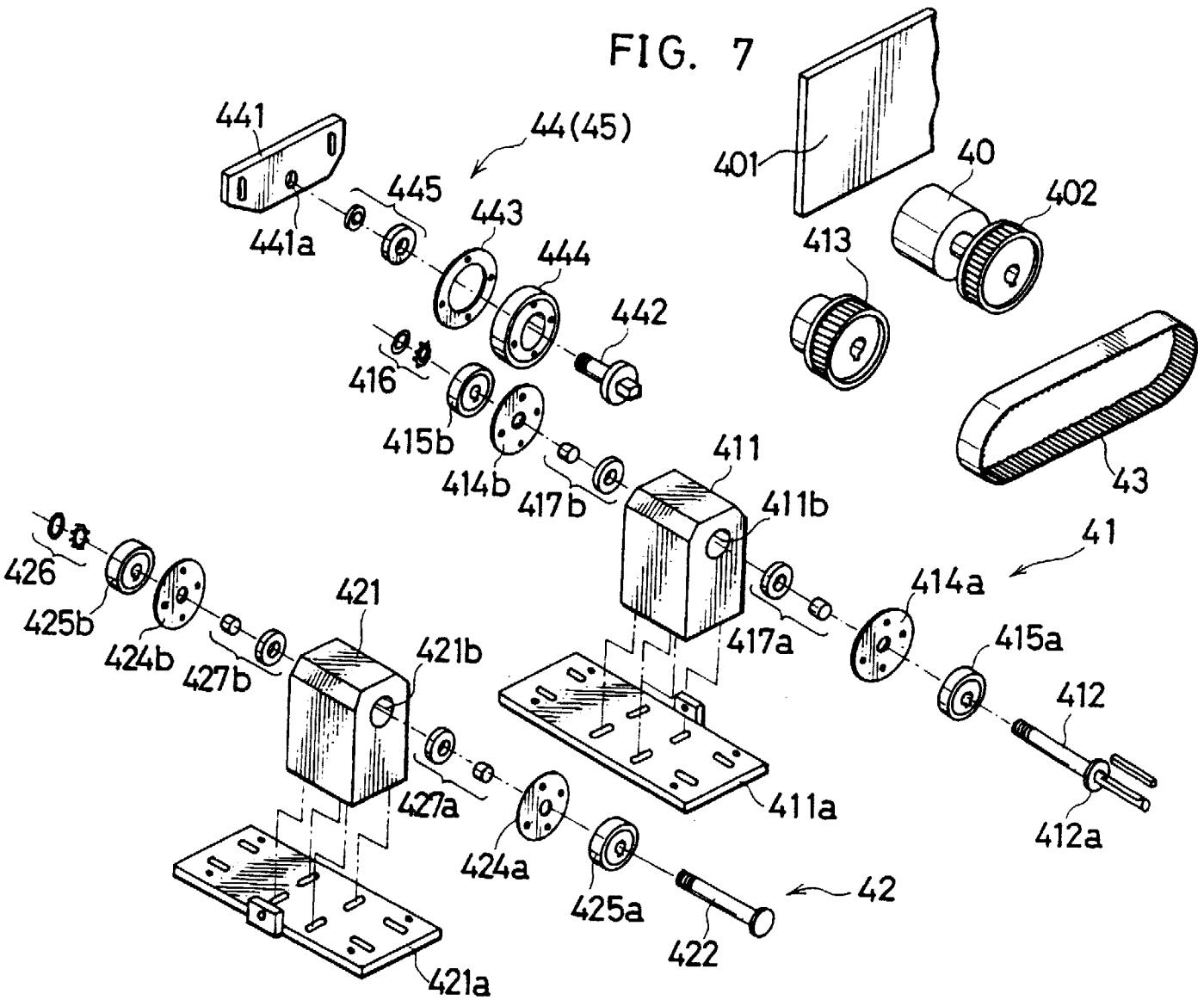
FIG. 7 is an exploded perspective view showing an essential portion of a rotating mechanism provided in the machine unit.
Figure 8A:
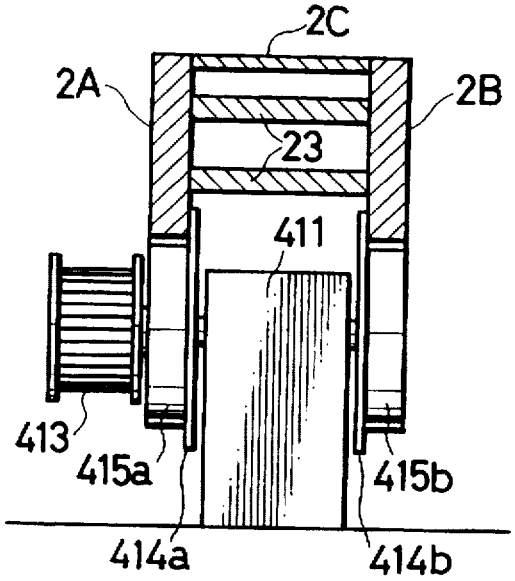
FIGS. 8A to 8C are sections showing the rotary wheel and its peripheral devices, FIG. 8A showing how the rotary wheel is supported by a main roller, FIG. 8B showing how the rotary wheel is supported by auxiliary rollers, and FIG. 8C showing a contact of the rotary wheel with power supply devices.
Figure 8B:
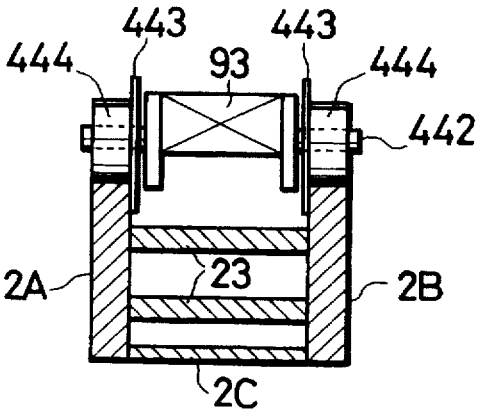
Figure 8C:
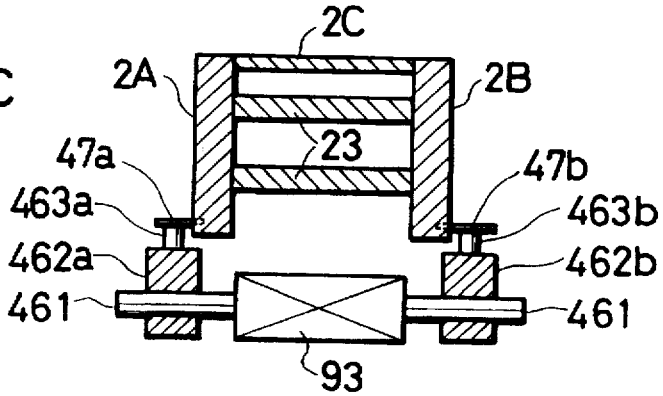

Next, the rotating mechanism 4 is described with reference to FIGS. 2, 3, 7 and 8. FIG. 7 is an exploded perspective view showing an essential portion of the rotating mechanism 4. FIGS. 8A to 8C are sections showing the rotary wheel and its peripheral devices, FIG. 8A showing how the rotary wheel is supported by a main roller, FIG. 8B showing how the rotary wheel is supported by auxiliary rollers, and FIG. 8C showing a contact of the rotary wheel with power supply devices.

The rotating mechanism 4 is disposed on the base 91 and the support plate 92 substantially symmetrically in the lateral direction as shown in FIG. 3. A drive roller 41 equipped with a motor 40 is disposed on the left side, and a driven roller 42 is disposed on the right side. Further, auxiliary driven rollers 44 and 45 are disposed laterally symmetrically at an upper part of the support wheel 93. The rotary wheel 2 is rotatably supported by the main rollers 41, 42 and the auxiliary rollers 44, 45. The motor 40 is driven such that the rotary wheel 2 rotates to the left for the first 5 balls B, and rotates to the right for the remaining 5 balls B. The rotary wheel 2 may be rotated in the same direction for all 10 balls B. Further, when the balls are collected after the completion of the game, the rotary wheel 2 is rotated to the left.

The drive roller 41 includes the motor 40 secured on a motor support 401, and a support block 411 mounted on a mount plate 411*a*. A timing pulley 402 is mounted on a rotatable shaft of the motor 40. A timing pulley 413 is so mounted on a rotatable shaft 412 of the support block 411 as to rotate together with the shaft 412. A timing belt 43 is mounted between the timing pulleys 402 and 413. A disk 414*a* and a roller 415*a*, a disk 414*b* and a roller 415*b* are mounted on the rotatable shaft 412 on the opposite sides of a through hole 411*b* formed in the support block 411, respectively. These disks and rollers are rotatable together with the shaft 412, and an axial movement thereof is restricted by a flange 412*a* of the shaft 412, an engaging ring member 416, and bearings 417*a*, 417*b*. The diameter of the disks 414*a*, 414*b* is slightly larger than the diameter of the rollers 415*a*, 415*b*, and are integral with the rollers 415*a*, 415*b* in the axial direction. By making the disks and the rollers integral with each other and varying the diameters thereof, contact positions of the rollers 415*a*, 415*b* with the ring plates 2A, 2B are not shifted.

The driven roller 42 basically has the same construction as the drive roller 41. Since a rotatable shaft thereof does not need a timing pulley, the driven roller 42 has no mount for the timing pulley and the rotatable shaft 422 is accordingly shorter.

FIG. 8A shows a state where the rotary wheel 2 is supported by the main rollers 41, 42. The circumferential surfaces of the ring plates 2A, 2B are in contact with the rollers 415*a*, 415*b*, respectively, and the disks 414*a*, 414*b* disposed inward of the rollers 415*a*, 415*b* and the ring plates 2A, 2B restrict the shifting of the rollers and the ring plates. The surface of the rollers 415*a*, 415*b*, or the rollers 415*a*, 415*b* themselves are made of resin to produce a specified surface friction, so that a driving force can be securely transmitted and the generation of noises can be prevented.

A pair of auxiliary rollers 44, 45 are rotatably mounted in upper left and right positions of the support wheel 2 (see FIG. 2). Specifically, these rollers 44, 45 are rotatably mounted on the support wheel 93 by way of a support member 441 as shown in FIG. 7. A shaft 442 is secured in a hole 441*a* of the support member 441. A disk 443 and a roller 444 which are made into an integral part are loosely mounted on the shaft 442, and an axial movement thereof is restricted by a restricting member 445.

FIG. 8B shows a state where the rotary wheel 2 is supported by the auxiliary rollers 44, 45. The circumferential surfaces of the ring plates 2A, 2B are in contact with the rollers 444, 454, respectively, and the disks 443, 453 disposed inward of the rollers 444, 454 and the ring plates 2A, 2B restrict the shifting of the rollers and the ring plates. Similar to the rollers 415*a*, 415*b*, the surface of the rollers 444, 454, or the rollers 444, 454 themselves are made of resin.

As described above, the rotary wheel 2 is supported in four positions: upper left and right positions, and lower left and right positions. Accordingly, if the motor 40 is driven at a fixed speed, rotating forces of the rollers 414*a*, 414*b* are efficiently transmitted to the rotary wheel 2, and thereby the rotary wheel 2 rotates at as fixed a speed as possible.

Since the mount plates 411*a*, 421*a* are formed with oblong holes extending in the longitudinal and lateral directions so that they can be adjustably mounted on the support 9, the positions of the rollers 415*a*, 415*b* can be securely adjusted. The support member 441 is also formed with oblong holes so that the position thereof can be easily and securely adjusted.

FIG. 8C shows a contact of the ring plates 2A and 2B with power supply devices 46. The power supply devices 46 are adapted to supply power from a stationary side to the rotary wheel 2, and are mounted on the support wheel 93 laterally symmetrically with respect thereto (see FIG. 2). Each power supply device 46 has a support arm 461 extending to the front (or rear) surface of the support wheel 93 (left or right side in FIG. 8C). Carbon support cylinders 462*a*, 462*b* are so mounted on the support arms 461 as to project toward the rotary wheel 2. The support cylinders 462*a*, 462*b* carry carbon rods 463*a*, 463*b* which are projectably and retractably biased by springs or like biasing members mounted in the support cylinders 462*a*, 462*b*, respectively. One of the carbon rods 463*a*, 463*b* acts as a positive electrode, and the other acts as a negative electrode. An unillustrated power source is connected between the carbon rods 463*a* and 463*b*. Annular conductive slip rings 47*a*, 47*b* are mounted in outermost positions of the ring plates 2A, 2B constituting the rotary wheel 2 such that they are partially exposed from the outer surfaces of the ring plates 2A, 2B, respectively. Power can be suitably supplied to the rotary wheel 2 by bringing the carbon rods 463*a*, 463*b* into sliding contact with the slip rings 47*a*, 47*b*, respectively. Particularly, by providing two or more power supply devices, power can be applied to the rotary wheel 2 even if one power supply device loses an electrical connection with the rotary wheel 2. Either positive or negative electrodes may be provided for each of the two power supply devices 46. This simplifies the construction of each power supply device.

Next, the ball feeding unit 1B is described.

Figure 9:
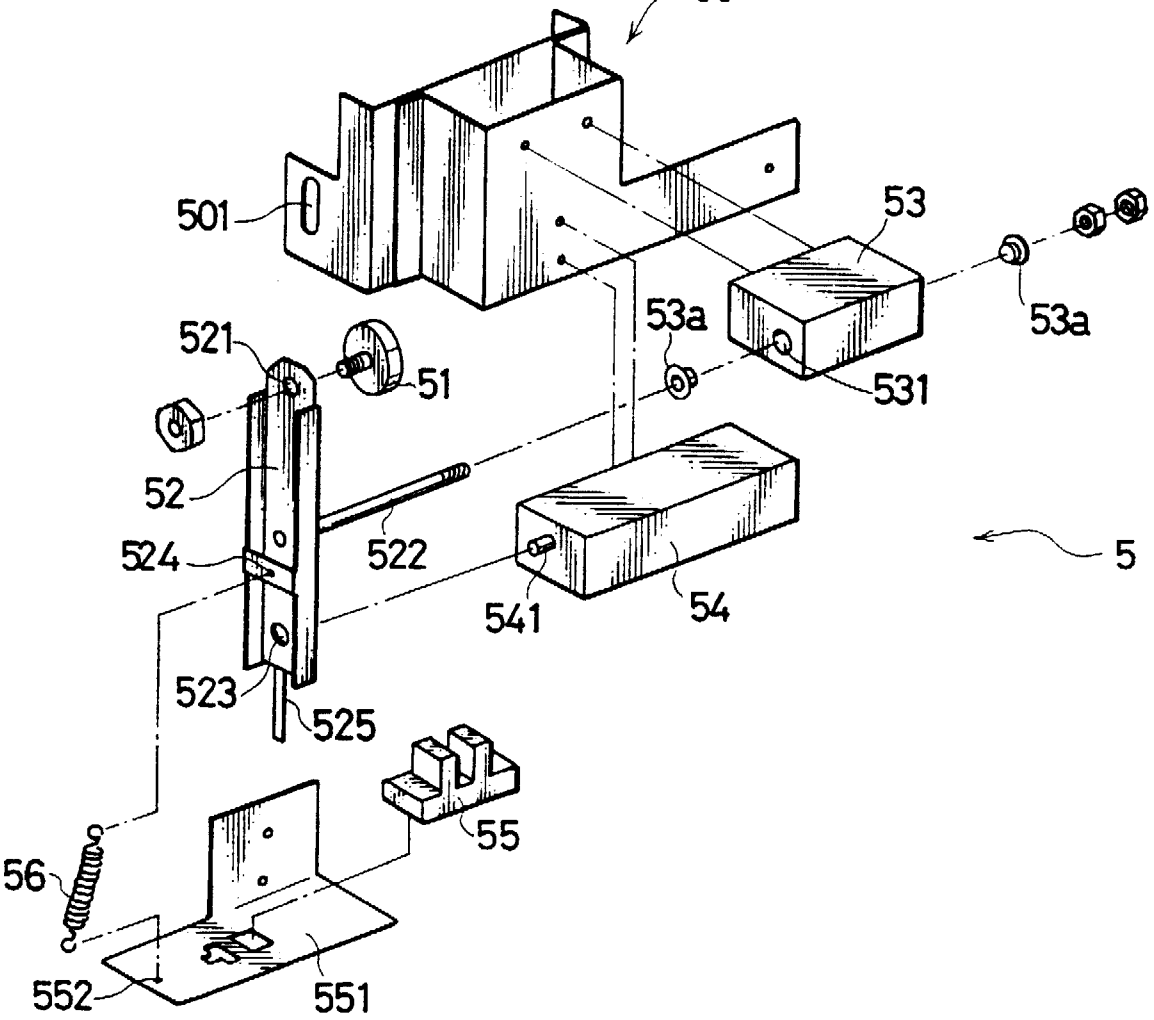
FIG. 9 is an exploded perspective view showing a collecting mechanism provided in the machine unit.
Figure 10B:
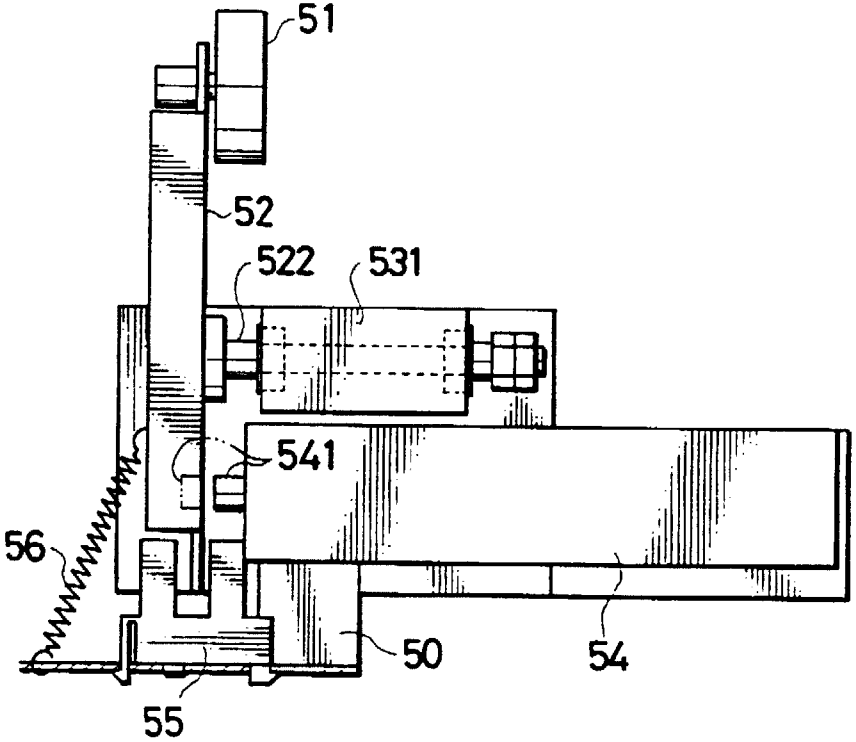
FIGS. 10A and 10B are a front view and a left side view of the collecting mechanism, respectively.
Figure 10A:
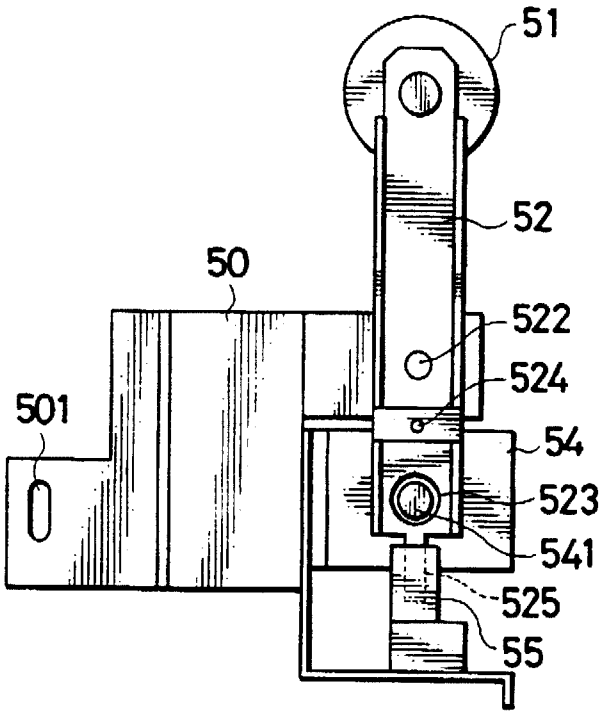

The construction of the collecting mechanism 5 is described with reference to FIGS. 9 and 10. FIGS. 9, 10A and 10B are an exploded perspective view, a front view and a left side view of the collecting mechanism 5.

The collecting mechanism 5 collects 10 balls B caught by the ball containers 20 and conveys them one by one to the supply device 6 after the completion of the game.

The collecting mechanism 5 includes a pivotal arm 52 having a contact roller 51 at its leading end. As shown in FIG. 2, the contact roller 51 is disposed on a trace of rotation of the pivotal portion 262*a* (shown in FIG. 6) of the claw member 262 of the outlet locking member 26 of each ball container 20. Identified by 50 is a base formed by a plurality of plate members. An oblong hole 501 is formed in the front surface of the base 50. The hole 501 acts as a mount hole for mounting the base 50 on the support block 411 and allows the position of the contact roller 51 to be adjusted in the vertical direction.

A support block 53 and a lock solenoid 54 are mounted at upper and lower parts of the right side surface of the base 50, respectively. The pivotal arm 52 includes an elongated plate formed with a support hole 521 for rotatably supporting the contact roller 51 such that the contact roller 51 is partially exposed upward from the elongated plate member. A pivotal shaft 522 extending in parallel with the shaft of the contact roller 51 stands in a substantially center position of the plate member with respect to its lengthwise direction. The plate member is also formed with a lock hole 523 at its bottom and a hook hole 524 at least below the pivotal shaft 522. A detecting portion 525 extends downward from the bottom end of the pivotal arm 52.

The pivotal shaft 522 is inserted into the support hole 531 of the support block 53 by way of a bearing 53*a*, with the result that the pivotal arm 52 is rotatably supported by the support block 53. A plunger 541 of the lock solenoid 54 faces the lock hole 523. When the lock solenoid 54 is turned on, the plunger 541 engages the lock hole 523 to restrict a pivotal movement of the pivotal arm 52. A collection timing sensor 55 mounted on a mount plate 551 is a photosensor for detecting the pivotal movement of the detecting portion 525, i.e. a timing at which the outlet of the ball container 20 faces a collection path 57 to be described later. This sensor may be a mechanical sensor.

The mount plate 551 is so mounted on the support arm 92 as to be located below the pivotal arm 52, and is formed in its specified position with a hook hole 552. A spring 56 is mounted between the hook holes 524 and 552 and biases the pivotal arm 52 such that the pivotal arm 52 keeps its vertical posture (i.e. the pivotal arm 52 is in its position where the plunger 541 engages the lock hole 523). A biasing force of the spring 56 is set smaller than a biasing force of the coil spring 264 lest the claw member 262 should pivot by contact with the contact roller 51 during the game. Thus, the caught balls B are not mistakenly collected.

Next, the operation of the collecting mechanism 5 is described. The lock solenoid 54 is turned off during the game. In this state, when the rotary wheel 2 rotates to bring the pivotal portion 262*a* of the claw member 262 into contact with the contact roller 51, the pivotal arm 52 pivots since the coil spring 264 has a larger biasing force than the spring 56, and accordingly the ball B remains in the ball container 20.

On the other hand, when the balls B are collected after the game, the rotary wheel 2 rotates to the right to bring the pivotal portion 262*a* of the claw member 262 into contact with the contact roller 51 and the pivotal arm 52 pivots. Then, it is detected that the outlet of the ball container 20 has come to the position where it faces the collection path 57, and the motor 40 is stopped. Thereafter, the lock solenoid 54 is turned on to restrict the pivotal movement of the pivotal arm 52. In this state, when the motor 40 is driven so that the rotary wheel 2 rotates to the left, the pivotal portion 262*a* of the claw member 262 comes into contact with the contact roller 51 and, conversely, the claw member 262 rotates. Then, the ball B in the ball container 20 is discharged through the outlet due to its weight or a centrifugal force, and the motor 40 is stopped. In this way, the balls are collected.

As shown in FIG. 2, the cylindrical collection path 57 is arranged upstream from the contact roller 51 with respect to the rotating direction of the rotary wheel 2 so as to face the outlets of the ball containers 20. The balls B discharged from the ball containers 20 are guided to the supply device 6 through the collection path 57. A gold ball sensor 58, which is a magnetic sensor, is disposed in a specified position on the side surface of the collection path 57. One of 10 balls B is a gold ball having a small mass of metal therein. The gold ball sensor 58 is provided internally with an inductance detector. Power is applied to this inductance detector so as to detect an inductance variation as a level change of an output voltage. The gold ball B acts as a so-called bonus in the bingo game.

Figure 11:
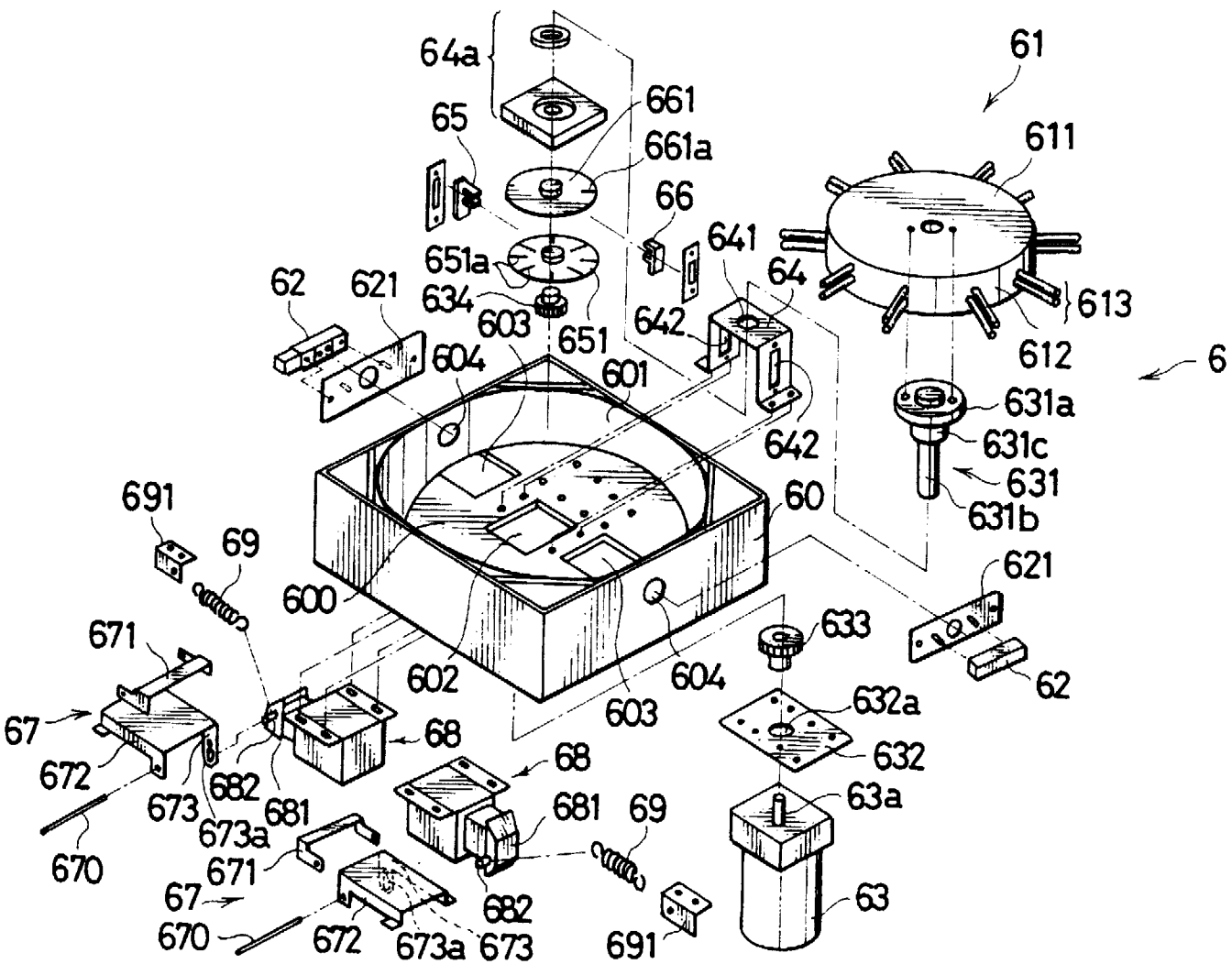
FIG. 11 is an exploded perspective view showing a supply device provided in the machine unit.
Figure 12:
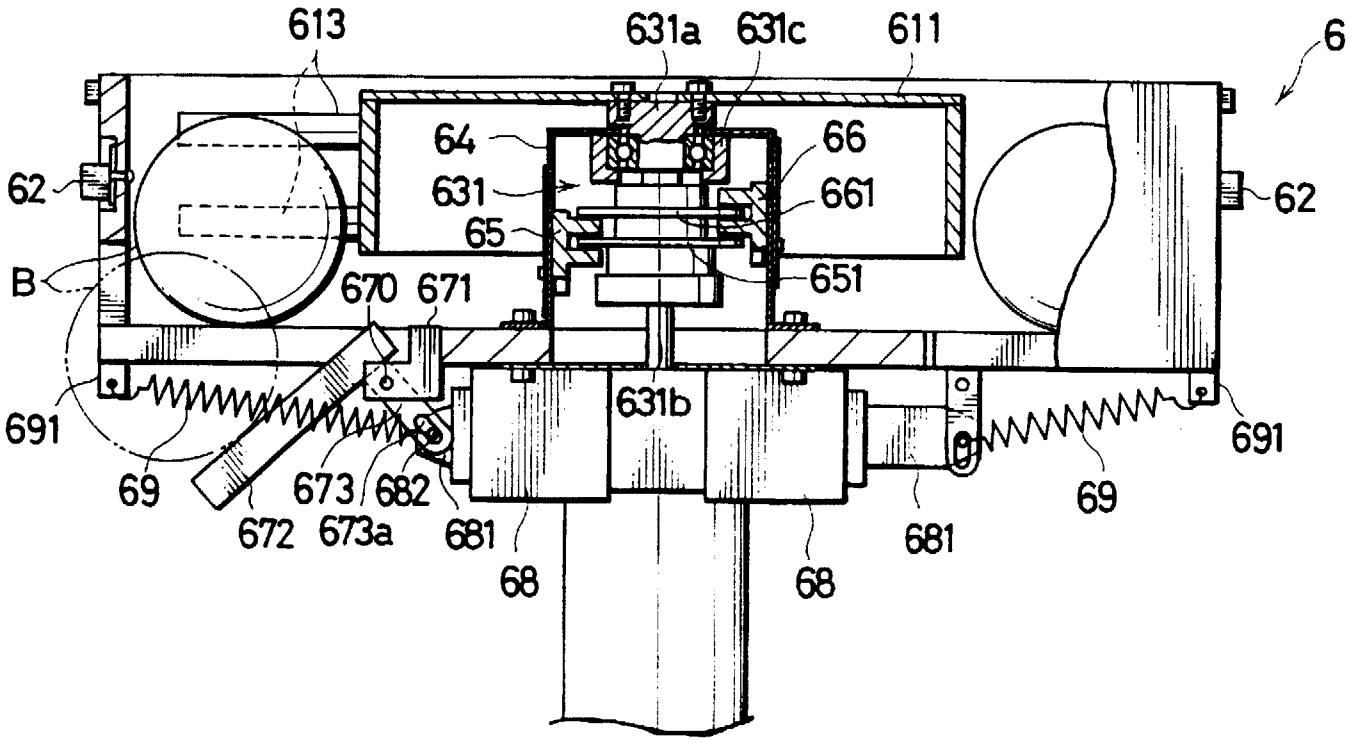
FIG. 12 is a front view partially in section of the supply device.

The construction of the supply device 6 is described with reference to FIGS. 11 and 12. FIGS. 11 and 12 are an exploded perspective view, and a front view, partially in section, of the supply device 6. The supply device 6 stores 10 balls B and supplies them one by one to the shooting devices 7.

The supply device 6 includes a box 60 for storing the balls B. In the box 60, a circular side plate 601 stands on a bottom plate 600 to define a cylindrical ball storage space. A ball storing member 61, to be described later, is rotatably mounted in this space. The bottom plate 600 of the box 60 is formed with a shaft hole 602 in its center and ball outlets 603 of such dimensions as to allow the balls B to pass therethrough symmetrically at the opposite sides of the shaft hole 602. Detection holes 604 are formed in the side plate 601 in positions corresponding to the ball outlets 603 and above the bottom plate 600 by a radius distance of the balls B. Ball supply sensors 64 are mounted on the box 60 via mount plates 621 so as to face the detection holes 604.

The ball storing member 61 is adapted to store the balls B as well as to guide the balls B to the ball outlets 603, and is rotatably mounted on a coupling shaft 631 together therewith. The member 61 includes a top plate 611, a cylindrical side plate 612, and separator arms 613 which radially project outward from the outer surface of the side plate 611 and are arranged in 10 equally circumferential spaced-apart positions. One collected ball B is stored between neighboring separator arms 613. In other words, the member 61 is capable of storing 10 balls B. The outlet of the collection path 57 is preferably located right above one of the two ball outlets 603, but they may not particularly correspond.

For example, two separator arms 613 may be arranged above and below the vertical center position in the extension of the coupling shaft 631 in each arrangement position. Then, as shown in FIG. 12, only the balls B can be securely detected at the same height as the ball supply sensors 62, with the result that the separator arms 613 does not engender an error in detecting the presence of the balls B.

A supply motor 63 is secured on the bottom surface of the bottom plate 600 via a motor mount member 632 formed with a through hole 632*a* in the center. A drive shaft 63*a* of the motor 63 projects upward from the shaft hole 602 of the bottom plate 600. A gear 633 is rotatably mounted at the upper end of the drive shaft 63*a* together with the drive shaft 63*a*.

On the other hand, a bracket 64, having opposite sides thereof bent downward, is mounted on the upper surface of the bottom plate 600 of the box 60 so as to enclose the shaft hole 602. A through hole 641 is formed in the center of the bracket 64. In the center of the upper plate 611 of the ball storing member 61, a coupling shaft 631 is so screwed as to project downward. As shown in FIG. 12, the coupling shaft 631 includes a bearing between an inner shaft 631*a* and an outer portion 631*c*. The inner shaft 631*a* and a rotatable shaft 631*b*, integral with and extending downward from the inner shaft 631*a*, are rotatable with respect to the outer portion 631*c*. The top of the inner shaft 631*a* is secured on the upper plate 611 of the member 61, and the outer portion 631*b* is secured on the bracket 64 via a holding member 64*a*.

A gear 634 is mounted at the bottom end of the rotatable shaft 631*b* to rotate therewith. The positions of the gears 633 and 634 are set on the same horizontal plate so that the gears 633 and 634 are at the same height and are in mesh with each other. A driving force of the supply motor 63 is transmitted to the inner shaft 631*a* via the gears 633 and 634, thereby rotating the ball storing member 61.

Detection holes 642 are formed in the opposite side plates of the bracket 64, being shifted in the vertical direction. A rotation sensor 65 and a reference position sensor 66, each consisting of a photosensor, are mounted in the respective detection holes 642 with their light emitting and receiving elements arranged in the vertical direction and faced inward. Further, rotary disk 651 and 661 are mounted on the rotatable shaft 631*b* between the light emitting and receiving elements of the rotation sensor 65, and between the light emitting and receiving elements of the reference position sensor 66, respectively.

The rotary disk 651 is formed with 10 slits 651*a* in circumferentially equally spaced-apart angular positions. The rotation sensor 65 detects the slits 651*a*, thereby detecting that the ball B stored between two neighboring separator arms 613 faces the ball outlet 603 to be supplied to the shooting device 7. The rotary disk 661 is formed with a slit 661*a* in one circumferential position. The reference position sensor 66 detects the slit 661*a*, thereby detecting that the ball storing member 61 is in a reference rotational position.

An opening member 67 opens and closes the ball outlet 603 and a solenoid 68 operates the opening member 67. The opening member 67 and the solenoid 68 are disposed in each supply hole 603 of the bottom plate 600. The opening member 67 includes a rotatable shaft 670, a support arm 671, and a lid 672 having opposite sides rotatably supported by the support arm 671. The opposite sides of the lid 672 are bent downward, thereby forming bent surfaces 673. The rotatable shaft 670 is inserted through holes formed in the bent surfaces 673 and the support arm 671 to rotatably support the support arm 671 and the lid 672 with respect to each other. The support arm 671 is, as shown in FIG. 12, secured on the bottom surface of the bottom plate 600 in a position closer to the center than to the outlet 603. The lid 672 rotates about the rotatable shaft 670, thereby opening and closing the ball outlet 603. When the ball outlet 603 is open, the lid 672 acts as a guide path for guiding the ball B to the shooting device 7 (both of the lids 672 are open in FIG. 2). The solenoid 68 is secured in a specified position on the bottom surface of the bottom plate 600, and includes a plunger 681. One bent surface 673 of the lid 672 is slightly longer than the other, and an oblong hole 673*a* is formed at one end thereof. An engaging pin 682, projecting in a direction normal to projecting and retracting directions of the plunger 681, is formed at the leading end of the plunger 681. The engaging pin 682 is fittable in the oblong hole 673*a*. A spring 69 applies a biasing force so as make plunger 681 project when the plunger 681 is released after the solenoid 68 is turned off (a state on the right side of FIG. 12). Accordingly, the ball outlet 603 can be securely closed by the lid 672. The spring 69 is mounted between the engaging pin 682 and an engaging member 691 secured in a specified position of the bottom plate 600.

In FIG. 12, the solenoid 68 is off and the ball outlet 603 is closed by the lid 672 on the right side, and the solenoid 68 is on and the ball outlet 603 is open on the left side.

The operation of the supply device 6 thus constructed is described. Upon the completion of the game, the solenoid 68 is turned off and the ball storing member 61 is set in its reference position based on the outputs from the rotation sensor 65 and the reference position sensor 66. In this state, the ball storing member 61 stores the balls B discharged one by one from the collecting mechanism 5. Upon the confirmation of storing of one ball B, the supply motor 63 is driven to rotate the ball storing member 61 by 36 degrees. When 10 balls B are all collected and stored, the supply device 6 enters a standby period until it supplies the balls B to the shooting devices 7. The balls B are supplied one by one to the shooting devices 7 as follows. By opening only one supply outlet 603, the five balls are successively supplied therethrough. By opening only the other supply outlet 603, the remaining five balls are supplied therethrough. In other words, 5 each of the balls are supplied through the two outlets 603. In this way, the balls B are supplied by turning on and off the solenoids 68 in synchronism with the 36 degrees rotation of the ball storing member 61 and each supply of five balls.

Figure 13:
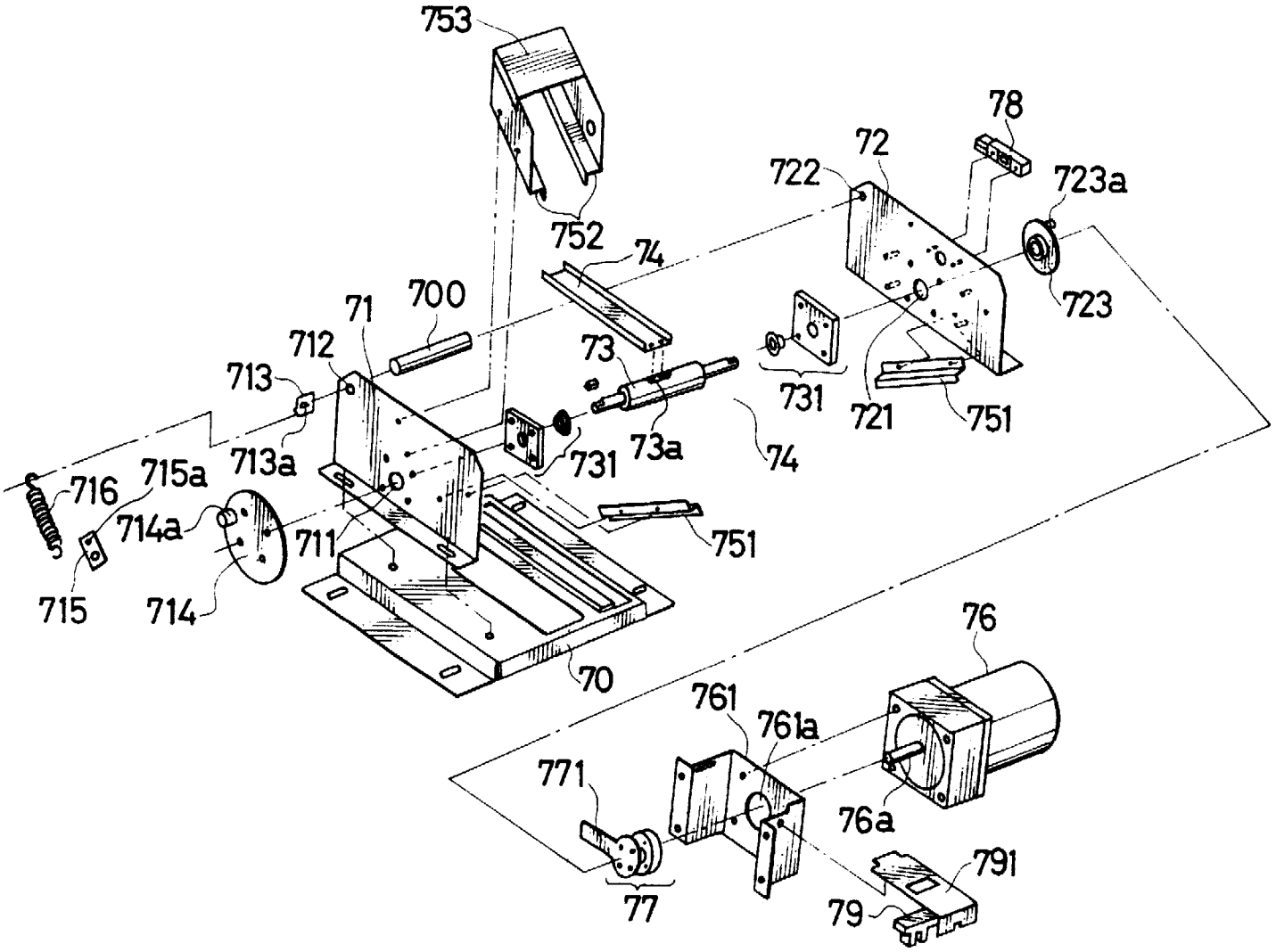
FIG. 13 is an exploded perspective view showing a shooting device provided in the machine unit.
Figure 14:
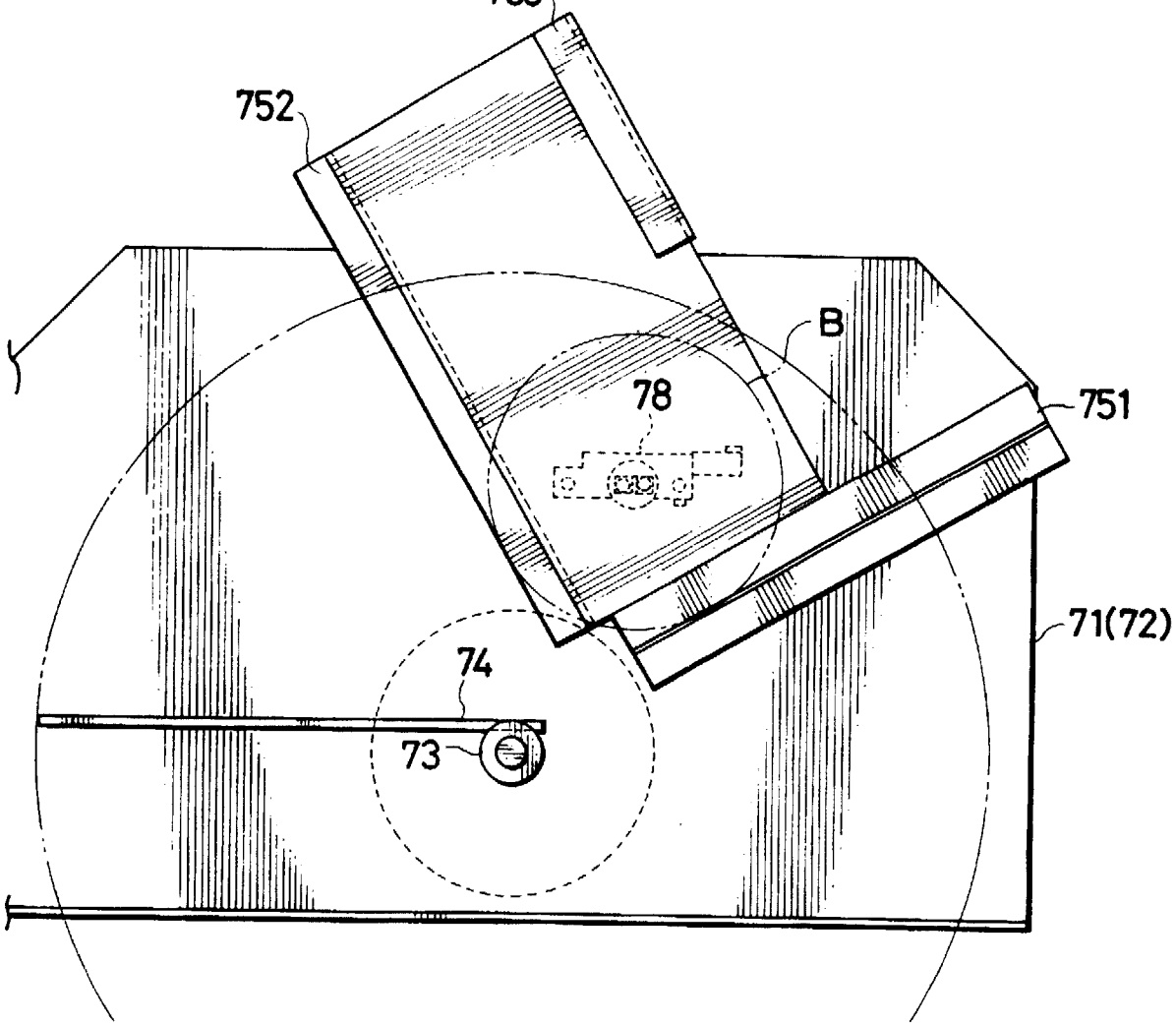
FIG. 14 is a front view showing a guiding portion for guiding the balls.
Figure 15:
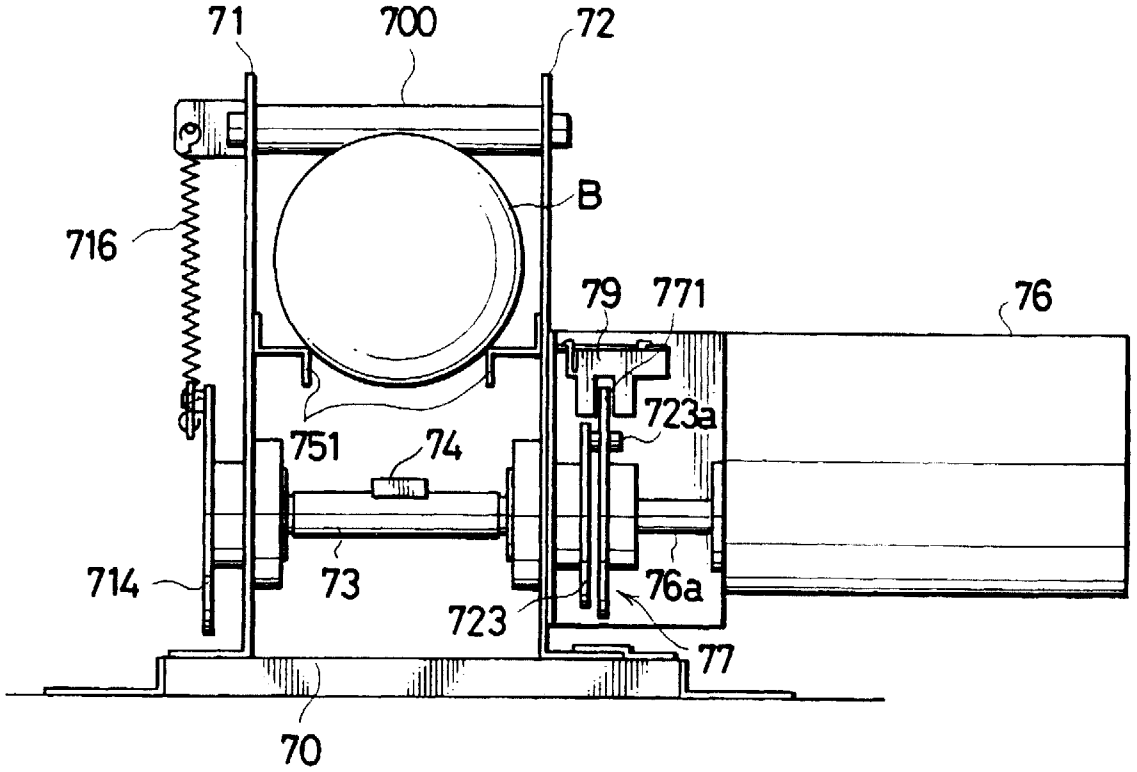
FIG. 15 is a right side view of the shooting device.

Next, the construction of the shooting device 7 is described with reference to FIGS. 13 to 16. FIG. 13 is an exploded perspective view of the shooting device 7; FIG. 14 is a front view showing how the ball B is guided; and FIG. 15 is a right side view of the shooting device 7. There are a pair of shooting devices 7 which are arranged in laterally symmetric positions. In other words, the shooting devices 7 are so disposed as to shoot the balls obliquely upward toward the outside.

Each shooting device 7 includes a base plate 70 and a pair of side plates 71 and 72 which stand in parallel at the opposite sides of the base plate 70. A hitting arm 74 is mounted on a rotatably shaft 73 between the side plates 71 and 72. More specifically, the side plates 71 and 72 are formed with support holes 711 and 721 in corresponding positions at their lower center portions, respectively. The rotatable shaft 73 is inserted into the support holes 711 and 721 by way of bearings 731, with the result that the shaft 73 is rotatably supported by the side plates 71 and 72.

A flat portion 73*a* is formed in a portion of the outer surface in the middle of the rotatable shaft 73. The hitting arm 74 is made of an elongated flat plate. The base end of the hitting arm 74 is secured on the flat portion 73*a* of the rotatable shaft 73 such that the hitting arm 74 extends in one direction normal to the longitudinal axis of the rotatable shaft 73.

A pair of guide rails 751 for guiding the ball B supplied from the supply device 6 are so mounted in corresponding positions at front portions of the inner surfaces of the side plates 71 and 72 as to have a specified inclination with respect to the hitting arm 74. The supplied ball B is guided along the guide rails 751 due to its weight until it comes into contact with guide rails 752. At the opposite sides of the guide rails 751 with respect to the hitting arm 74, a pair of guide rails 752 for guiding the hit ball B to guide rails 754, described later, are mounted on the side plates 71 and 72 via a suspended portion 753. The guide rails 752 of a specified length have an upward inclination with respect to the hitting arm 74.

The guide rails 751 and 752 are connected at their ends so that the ball B, guided along the guide rails 751 and in contact with the guide rails 752, is placed on the guide rails 752 as shown in FIG. 14 when the hitting arm 74 starts rotating counterclockwise to hit the ball B. The ball B hit by the hitting arm 74, which had been rotated by 360 degrees, moves upward along the guide rails 752 and, then, along the guide rails 754.

Holes 712 and 722 are formed at corresponding upper corners of the side plates 71 and 72, respectively. A coupling pin 700 is mounted between the holes 712 and 722 to securely hold the side plates 71 and 72. Taking advantage of the hole 712 for supporting the coupling pin 700, an engaging portion 713, formed with a hook hole 713*a* for a spring 716 to be described later, is mounted in a position upward and at 45 degrees from the support hole 711 on the outer surface of the side plate 71. A rotary disk 714 is mounted on the end of the rotatable shaft 73 projecting outward from the support hole 711 of the side plate 71. An engaging pin 714*a* is provided in one position of the rotary disk 714, displaced from its center, and at 45 degrees from the leading end of the hitting arm 74 with respect to a direction opposite from the rotating direction of the hitting arm 74. A member 715, formed with a hook hole 715*a*, is mounted on the engaging pin 714*a*. The spring 716 is mounted between the hook holes 713*a* and 715*a*. The spring 716 applies a force to the hitting arm 74 when the hitting arm 74 is rotated to a position where it faces vertically upward and hits the ball B. In other words, the rotating speed of the hitting arm 74, by which it returns to its initial position, is accelerated by the compressive force of the spring to obtain a suitable ball driving speed.

On the other hand, a rotary disk 723 is mounted at an end of the support shaft 73 coming out of the support hole 721 on the outside of the side plate 72 to rotate with the support shaft 73. An engaging projection 723*a* is provided at a position on the rotary disk 723 displaced from its center and at 45 degrees from the leading end of the hitting arm 74 with respect to the rotating direction of the hitting arm 74. Further, a bracket 761, which is U-shaped when viewed from above and is adapted to support a motor 76, is so mounted on the outer surface of the side plate 72 as to cover the rotary disk 723. The motor 76 is mounted on the outside of the bracket 761, and its drive shaft 76*a* faces the side plate 72 through a hole 761*a* formed in the bracket 761. A driving force transmitting member 77 is mounted at the leading end of the drive shaft 76*a* to rotate therewith. The transmitting member 77 is formed with a contact portion 771 extending in one radial direction, and transmits the driving force of the motor 76 to the hitting arm 74 via the support shaft 73 when the contact portion 771 is in contact with the engaging projection 723*a* of the rotary disk 723.

Identified by 78 is a shooting ball sensor consisting of a photosensor for confirming the presence of the ball B in a hitting position. The shooting ball sensor 78 is mounted on the inner surface of the side surface 72. Identified by 79 is a reference position sensor consisting of a photosensor for confirming a reference position of the motor by detecting the contact portion 771. The reference position sensor 79 is mounted in a specified upper position of the bracket 761 via a support member 791 such that the contact member 771 passes through a clearance between light emitting and receiving elements of the sensor 79 when it faces vertically upward.

Identified by 754 are a pair of guide rails which are disposed at the opposite lateral sides of the rotary wheel 2 and continuously extend from the guide rails 752 of the respective shooting devices 7. Each rail 754 has a substantially semicircular shape extending from the bottom part to the upper part of the rotary wheel 2 outside the support wheel 93. The rails 754 are spaced apart from the rotary wheel 93 to define such a clearance as to allow the ball B to smoothly pass and prevent the ball B from coming out in a lateral direction. Each guide rail 754 is formed by two pipes or bars which are spaced apart in parallel by a predetermined distance lying in a range of about a radius of the ball B to a distance slightly shorter than the diameter of the ball B. The ball B is guided from the shooting device 7 to the guide device 8 located above while rotating between the two pipes.

The operation of the shooting device 7 thus constructed is described. First, the hitting arm 74 is held in its horizontal position by the compressive force of the spring 716. When the ball B is guided from the supply device 6 to the hitting position along the pair of the guide rails 751, its presence is detected by the ball sensor 78. After the presence of the ball B is confirmed, the motor 76 is started and its driving force is transmitted from the contact portion 771 to the engaging projection 723*a*, with the result that the hitting arm 74 is rotated counterclockwise in FIG. 14. When the hitting arm 74 makes a half turn, i.e. when it comes to another horizontal position in the opposite direction, it is rotated not only by the driving force of the motor 76, but also by the compressive force of the spring 716, thereby increasing the rotating speed of the hitting arm 74. The hitting arm 74 hits the ball B hard while it is returning to its initial position. The motor 76 is stopped when the reference position sensor 79 detects that the contact portion 771 has come to face vertically upward. The hit ball B is guided upward along the guide rail 752 and the guide rail 754, continuously extending from the guide rail 752, to the guide device 8.

Figure 17:
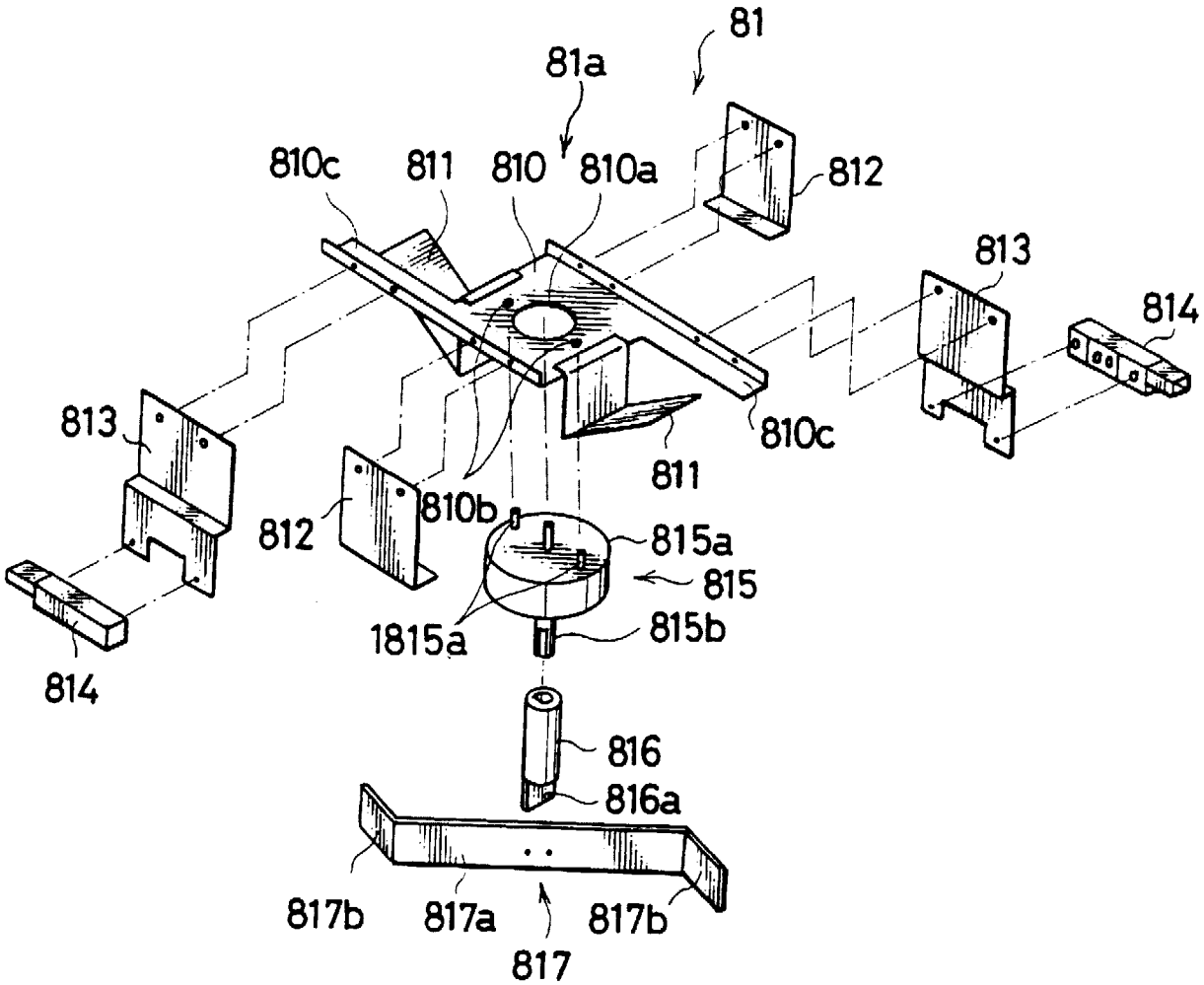
FIG. 17 is an exploded perspective view showing a ball dividing mechanism provided in the machine unit.
Figure 18A:
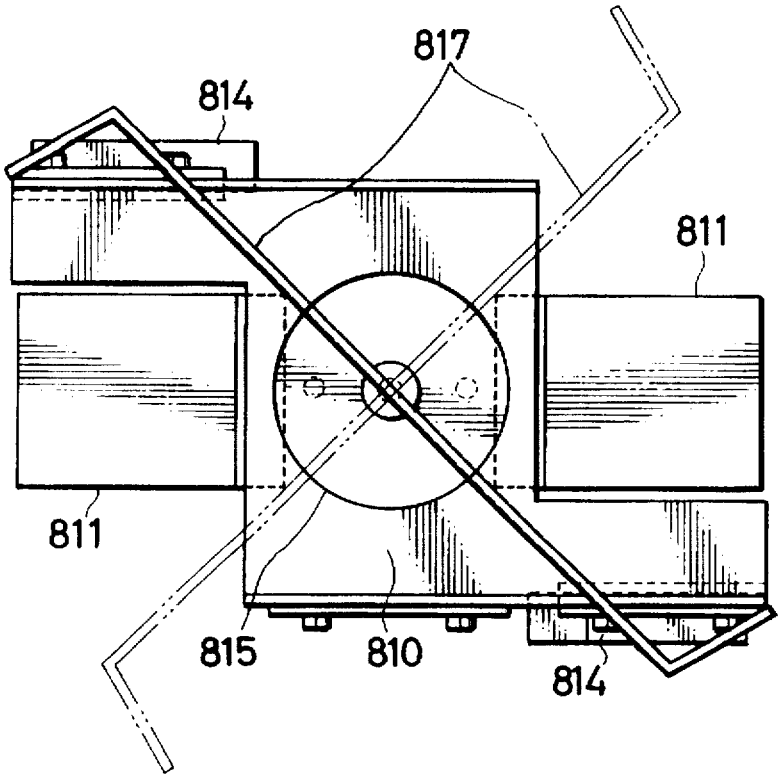
FIGS. 18A and 18B are bottom and front views of the ball dividing mechanism.
Figure 18B:
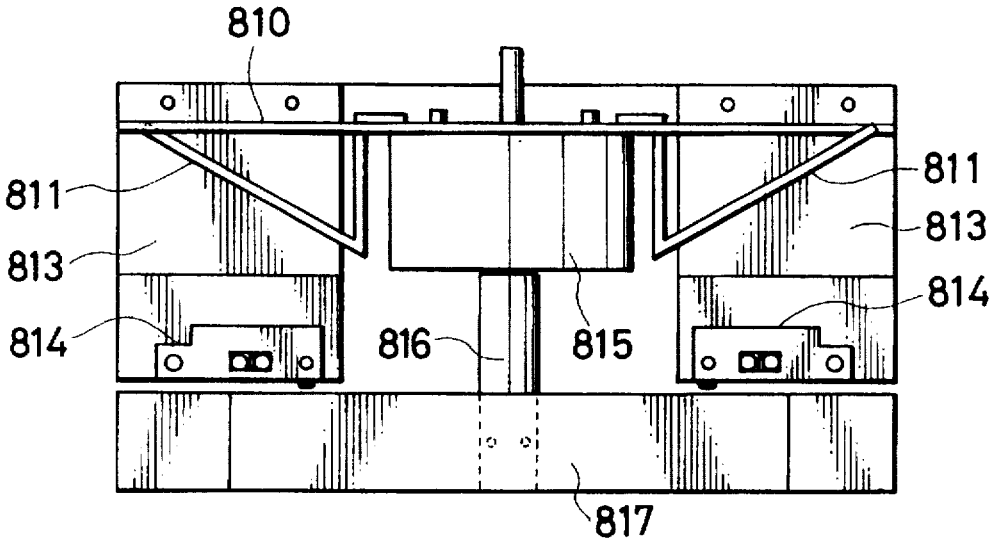

The construction of the guide device 8 is described with reference to FIGS. 16 to 18. FIG. 16 is an exploded perspective view showing a structure of a chute of the guide device; FIG. 17 is an exploded perspective view of the ball dividing mechanism; and FIGS. 18A and 18B are bottom and front views of the ball dividing mechanism.

As shown in FIG. 2, the guide device 8 is disposed at the top of the machine unit 1 and adapted to receive the ball B from the guide rail 754 and to introduce the received ball B between the plate members 31 of the fixed disk 3.

In FIG. 16, a chute 80 of the guide device 8 includes a pair of parallel vertical base plates 800 which are so disposed as to hold the upper ends of the corresponding pipes of the guide rails 754. Though only one base plate 800 is shown in FIG. 16, in order to simplify the description, another base plate having the same construction as the one shown in FIG. 16 is so mounted on the support wheel 93 as to face the other in the forward/backward direction.

As shown in FIG. 16, the base plate 800 is formed with a closed rectangular notch 801*a* at its upper center portion and an open rectangular notch 801*b* at its lower center portion. The notch 801*b* is open at the bottom of the base plate 800. The notch 801a introduces the ball B allocated by a ball dividing mechanism 81 shown in FIGS. 17 and 18 to the chute 80.

A passage portion 802, having a U-shaped cross section, is mounted on the base plate 800 right below the notch 801*a*, the passage portion 802 being adapted to form a passage together with the surface of the base plate 800. The passage portion 802 includes a contact plate 802*a* for securely introducing the ball B allocated to the front side by the ball dividing mechanism 81 to the passage, and a bottom end thereof extends to a position right above the notch 801*b*. A junction passage portion 803 having a U-shaped cross section is so mounted as to extend substantially right below an outlet at the bottom of the passage portion 802 and to cover the notch 801*b*. The junction passage portion 803 is open at its top and its front plate is inclined toward the base plate 800 between an intermediate vertical position to the lower end. The balls allocated and fallen to the front and rear sides are joined by the notch 801*b*, which then introduces the balls B right below the base plate 800, i.e. between the plate members 31 of the fixed disk 3.

In a specified position of the junction passage portion 803 or the base plate 800, there is mounted a ball drop sensor 804 consisting of a photosensor for detecting the ball B falling from the bottom end of the junction passage portion 803.

Lights 805 for illumination are mounted on the base plate 800 on the opposite lateral sides of the junction passage portion 803 via support members 805*a*, respectively. A panel 806, for covering the guide device 8, is disposed at each of the front and rear sides of the base plate 800. Each panel 806 is formed with openings 806*a* and 806*b* in upper and lower positions. A decoration plate 807, on which the name of the game and, if necessary, a variety of characters and signs are written, is mounted in the upper opening 806*a*. A display device 808, consisting of LED segments for displaying two characters, is mounted in the lower opening 806*b* via a support frame 808*a*. In the case where the bingo game is played using numbers of 1 to 25, the display device 808 includes so-called seven segment devices, each capable of displaying numbers of 0 to 9. A special sign peculiar to the ball container 20 having caught the ball B is displayed in the display device 808.

Next, the construction of the ball dividing mechanism 81 is described with reference to FIGS. 17, 18A and 18B. A support plate 812 is not shown in FIG. 18B.

A direction changer 81*a* includes a ceiling plate 810 and ball contact plates 811. The ceiling plate 810 is formed with a shaft hole 810*a* in the center and two mount holes 810*b* at the opposite sides of the shaft hole 810*a*. Arms 810*c* extend from front and rear parts of the ceiling plate 810 to the left and to the right, respectively. Each ball contact plate 811 has its upper end mounted on a corresponding lateral edge of the ceiling plate 810, and is suspended therefrom. The contact plates 811 are adapted to change a moving direction of the ball B guided from the lateral sides downward. Each contact plate 811 extends downward from the upper end and is bent outward in its intermediate vertical position. The bent portion of the contact plate 811 has a suitable inclination of about 30 degrees to 45 degrees with respect to the vertical extending portion thereof and extends to about the height of the ceiling plate 810. The above inclination is determined based on the speed of the balls B guided from the lateral sides, the positions of an allocating plate 817 to be described later and the passage portion 802 disposed below, and other factors.

Support plates 812, for supporting the guide rails 754 are so mounted as to project downward at front and rear portions of the ceiling plate 810, and sensor mount plates 813 are so mounted as to project downward from the opposite extension arms 810*c*. A ball guide sensor 814, consisting of a photosensor for detecting the bottom of the bent or oblique portion of the ball contact plate 811, is mounted in each sensor mount plate 813. The ball guide sensor 814 detects that the ball B, having come to contact with the ball contact plate 811, underwent a large change of direction toward downward.

Identified by 815 is a known rotary solenoid. When an electrical ON signal is applied to the rotary solenoid 815, i.e. when the rotary solenoid 815 is turned on, a rotary plunger 815*b* rotates by a specified angle, e.g. 90 degrees with respect to a base 815*a*. On the other hand, when the rotary solenoid 815 is turned off, the rotary plunger 815*b* rotates to its initial angular position. The rotary solenoid 815 is suspended vertically from the ceiling plate 810 by inserting screws 1815*a* through fixing holes 810*b* of the ceiling plate 810 and fastening them with bolts.

A hollow cylinder 816 is fitted around the rotary plunger 815*b* rotate therewith. Identified by 817 is an allocating plate made of an elongated plate member. A middle portion of the allocating plate 817, with respect to its longitudinal direction, is mounted on a flat portion 816*a* of the cylinder 816 so that it rotates about the axis of the rotary plunger 815*a* in a horizontal plane. The allocating plate 817 includes a center flat portion 817*a* to be coupled with the cylinder 816, and bent portions 817*b* at the opposite ends. The bent portions 817*b* are bent at substantially 90 degrees or an obtuse angle in the same circumferential direction.

In a reference position, the allocating plate 817 is at about 45 degrees to the horizontal direction as shown in FIG. 18A. The ball B, oriented downward by the ball contact plate 811, comes into contact with the center flat portion 817*a*, thereby being oriented to an obliquely downward direction to the right by the ball contact plate 811, and is further oriented toward forward by the allocating plate 817 (upward in the bottom view of FIG. 18A). Thus, the ball B having been guided from the left side is guided to the junction passage portion 803 through the passage portion 802 on the left side of FIG. 16. Further, in FIGS. 18A and 18B, the ball B having been guided from the right side is oriented toward backward (downward in the bottom view of FIG. 18A), with the result that it is guided to the junction passage portion 803 through an unillustrated passage portion 802 on the right side of FIG.

16. The randomness of the game is further enhanced by guiding the balls hit from the right and left sides to the fixed disk 3 by way of different passages arranged on the front and rear sides.

When the ball drop sensor 804 does not detect the ball B, hit by the shooting device 7 despite the fact that the ball guide sensor 814 detected it, the ball B might have made an undesirable movement and become stuck in the guide device 8. In such a case, the rotary solenoid 815 is turned on to rotate the allocating plate 817 by 90 degrees (indicated by phantom line in FIG. 18A). This prevents the balls B from being stuck in the guide device 8.

Figure 19:
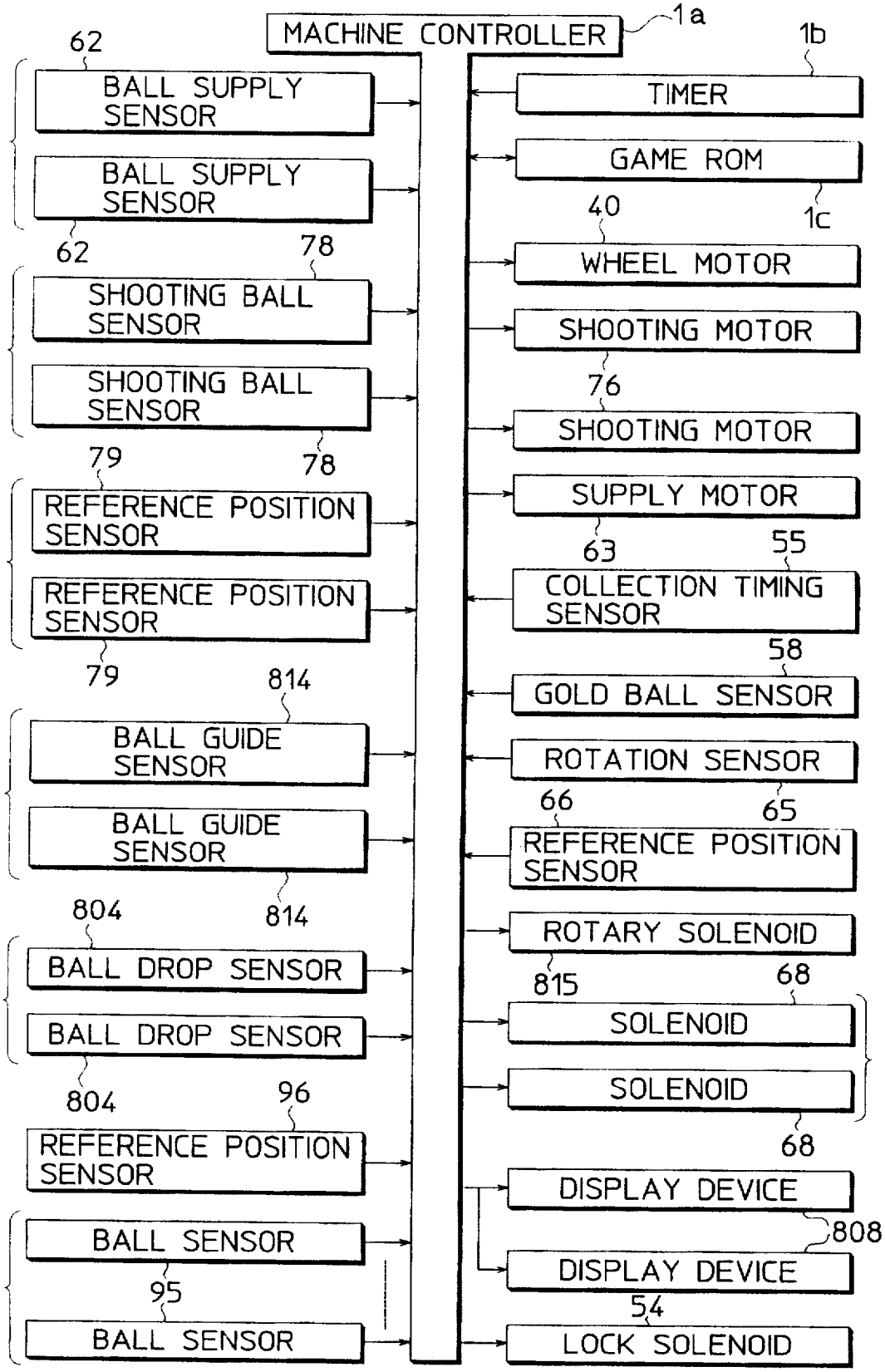
FIG. 19 is a block diagram showing a construction of a machine controller of the machine unit.

FIG. 19 is a block diagram showing a construction of a machine controller for the machine unit 1. The machine controller is disposed in a specified position in the support 9 of the machine unit 1, and includes a machine controller 1*a* for centrally controlling an operation sequence of the machine unit 1, a timer 1*b* for administering processing times, and a ROM 1*c* for storing a sequence program for the game of the machine unit 1. Special signs are stored in the ROM 1*c* in correspondence with 25 ball containers 20. The machine controller 1*a* is connected with all sensors and switches of the machine unit 1, and reads a variety of information from these sensors and switches. The machine controller 1*a* implements a sequence program in accordance with the read information, and outputs drive signals to respective motors and solenoids and a display signal to a display system. The machine controller 1*a* judges which ball container(s) 20 accommodate(s) the ball(s) B in accordance with the detection signals from the ball sensors 95 and the reference position sensor 96, and reads the special sign(s) peculiar to the ball container(s) 20 from the ROM 1*c*. The operations of the respective elements of the machine unit 1 in performing the game are described with reference to flowcharts to be described later.

Figure 20:
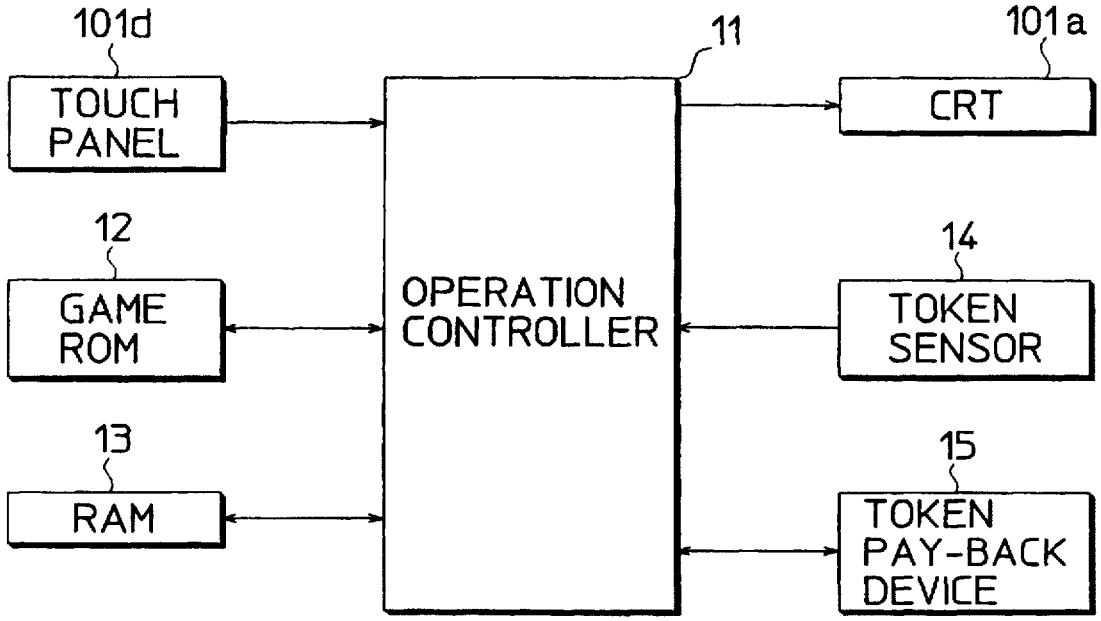
FIG. 20 is a block diagram showing a construction of a controller for an operation/display unit.

FIG. 20 is a block diagram showing a construction of a controller for the operation/display unit 10. This controller is provided in the respective game terminals 101, 102, . . .

Identified by 11 is an operation/display controller for centrally controlling a display of game contents to the display 101*a* of the terminal and a change in the display contents according to instructions. Specifically, the operation/display controller 11 performs processes in accordance with a basic game rule required to perform the game and displays the processed contents. The processes include selection of a square of a bingo card having a sign corresponding to the selected sign, display of a square corresponding to the selected sign, deciding the winner of the game, and counting of the number of tokens to be paid back. This controller is also provided with a game ROM 12 for performing a process in response to an instruction given from the player and a RAM 13 for temporarily storing the contents being processed. The game ROM 12 stores image data forming the respective screens of image. The game ROM 12 displays an image according to the progress of the game or according to the instruction given from the player, and stores a variety of data concerning the bingo cards to be described later. Further, the operation/display controller 11 reads the measured time information of the reflected wave from the touch panel 101*d* and compares the read information with the content displayed in the display 101*a*. The operation/display controller 11 is connected with a token insertion sensor 14 disposed inside a token inlet and a token pay-back device 15, and judges insertion of a token (start of the game) and administers the number of tokens to be paid. Furthermore, the operation/display controller 11 communicates with the machine controller 1*a* to obtain necessary information.

The operation of the bingo game machine according to the invention is described with reference to FIGS. 21 to 24.

Figure 21:
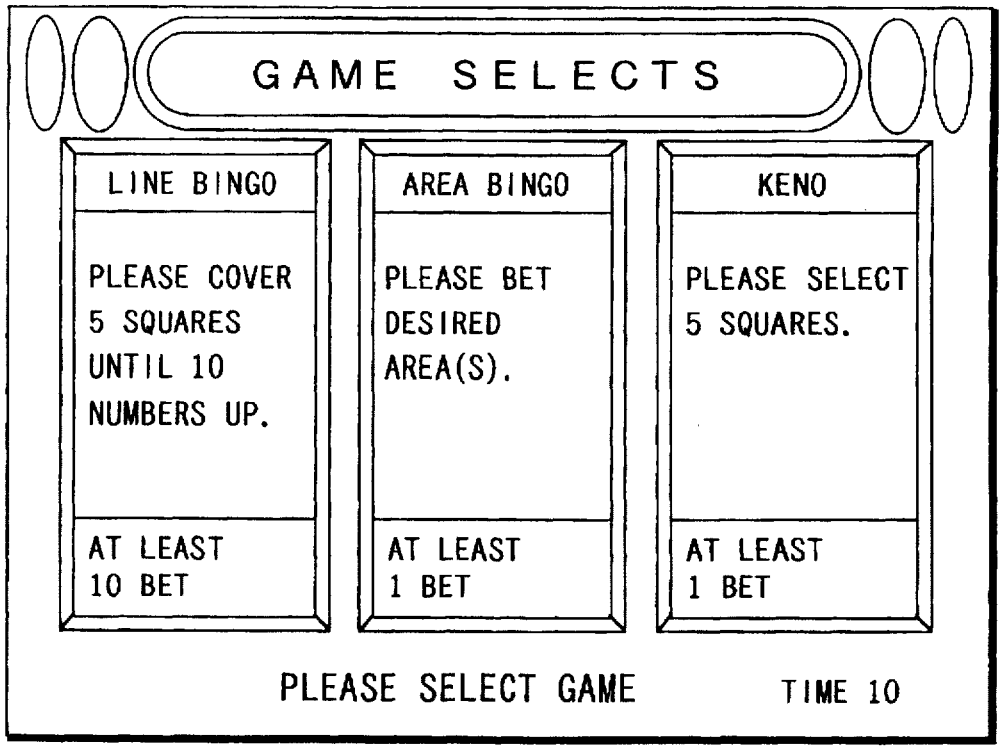
FIG. 21 is a diagram showing a game select screen image displayed in a display unit of the bingo game machine.

The bingo game can be played by at minimum one person, at maximum as many as the number of game terminals. Upon insertion of a token, a game select screen image, as shown in FIG. 21, is displayed. There are three selectable games: "Line Bingo", "Area Bingo" and "Keno". In a frame of each game, there are displayed a game content, a bet or the number of tokens needed. When the player presses a specified position within the frame to select the game, the operation/display controller 11 confirms the pressed position and displays a game screen image of the selected game (FIGS. 22 to 24).

Figure 22:
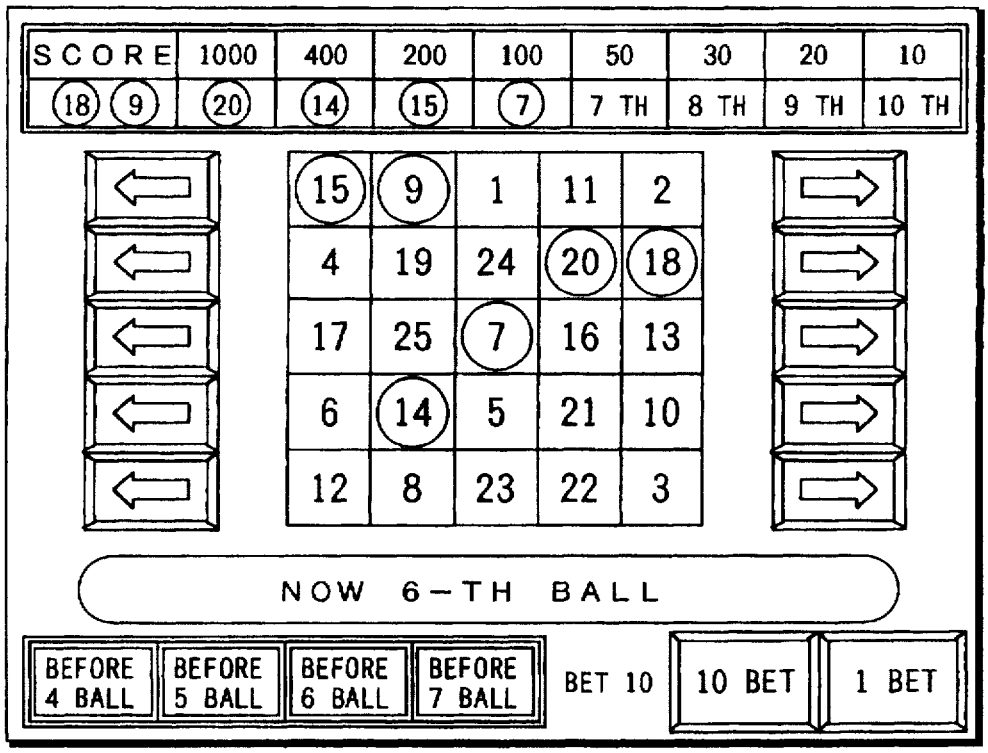
FIG. 22 is a diagram showing a screen image when "Line Bingo" is selected.
Figure 23:
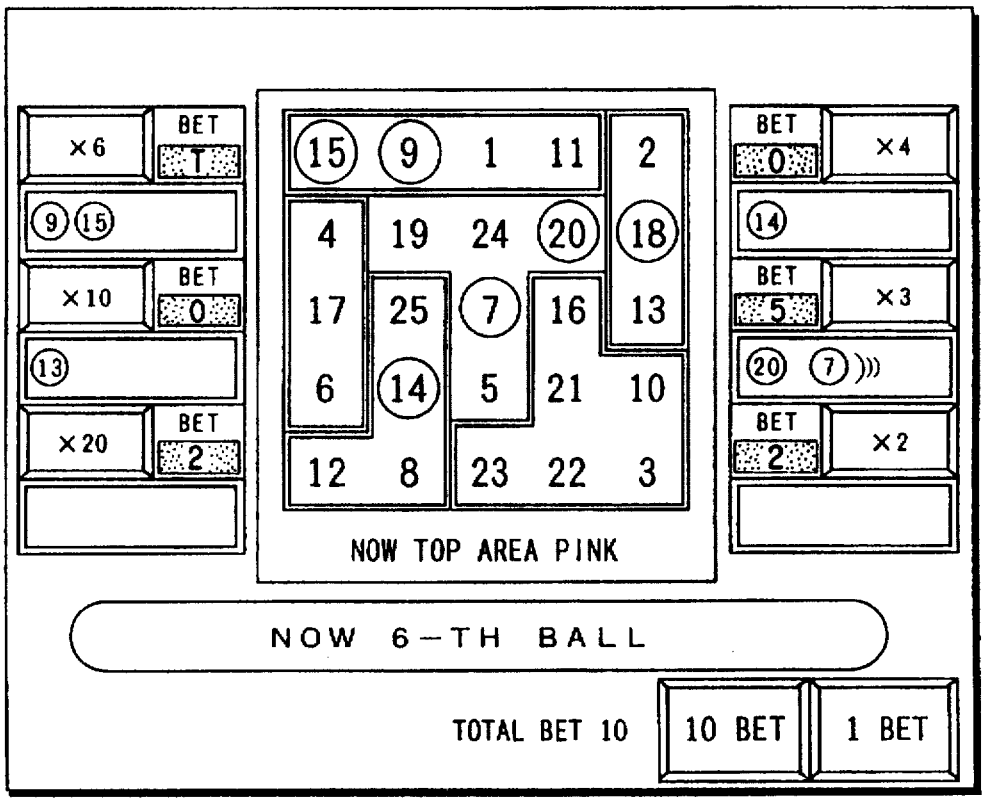
FIG. 23 is a diagram showing a screen image when "Area Bingo" is selected.
Figure 24:
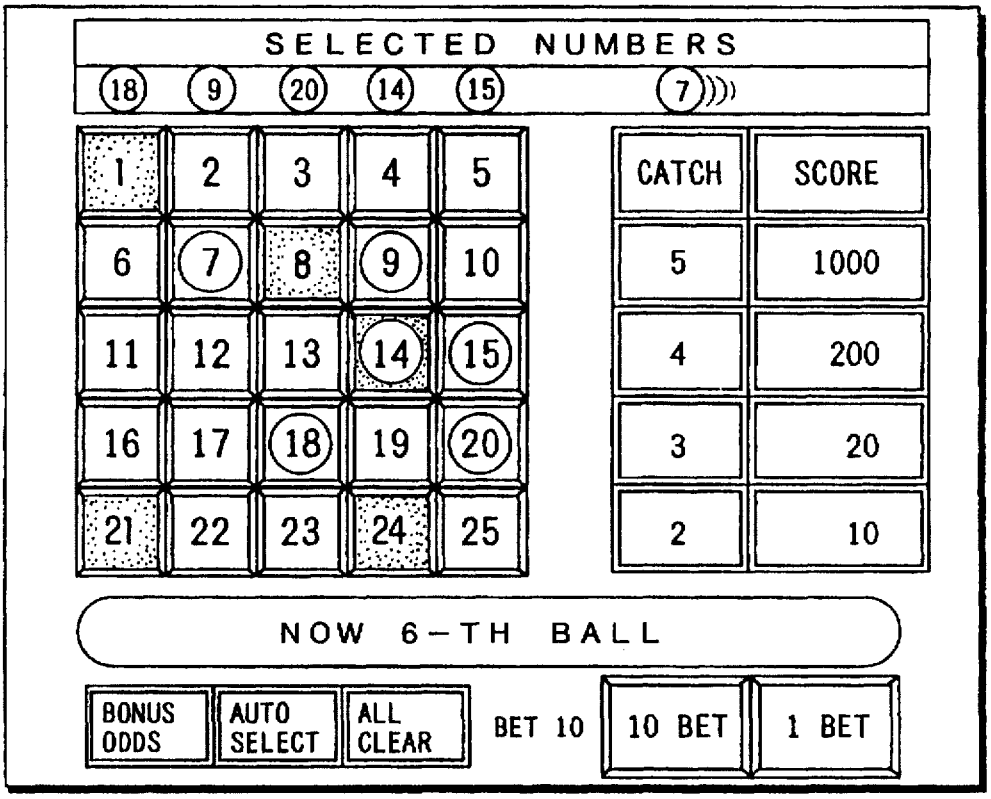
FIG. 24 is a diagram showing a screen image when "Keno" is selected.

FIGS. 22, 23 and 24 show screen images when the "Line Bingo" is selected, when the "Area Bingo" is selected, and when the "Keno" is selected, respectively. If a selection is not made within a predetermined time at this stage, the player cannot participate in a present game and has to wait for a next game.

In the "Line Bingo" shown in FIG. 22, a bingo card including 5×5 squares is displayed in the center of the screen. The bingo card is such that the same number of squares are arranged in row and column directions and different signs are allotted to the respective squares. In this game, if the numbers on the bingo card corresponding with the numbers on 10 balls selected by the machine unit 1 (that means the special signs peculiar to the ball containers 20 having caught the balls B in this invention) cover any line, consisting of 5 squares, on the bingo card (there exist 12 lines in total: 5 vertical lines, 5 horizontal lines, and 2 diagonal lines), the player wins and tokens are paid to him. The player loses if no line is completed after selection of 10 balls. The bet is made as follows. One token is valid for one line. Nine tokens are valid for nine lines. At maximum 10 tokens are valid for 12 lines. In this way, the game can be played according to the number of tokens the player currently has.

Arrow marks as shift designation means are displayed on the opposite lateral sides of the bingo card. Each time the arrow mark is pressed, the operation/display controller 11 changes a display so that the corresponding row moves by one square in a direction defined by the arrow mark. Thus, the player can obtain an arrangement of numbers which he thinks advantageous to him. An order of numbers newly displayed in this row are basically the same as the one of the previously displayed numbers which were erased upon the shift. The erased numbers may be randomly rearranged and newly displayed. In other words, the operation/display controller 11 carries out a processing to rearrange the erased numbers in the row direction randomly or in accordance with a specified relationship, and displays the numbers in the arrangement after the processing.

Right below the bingo card, there is displayed the number of already shot balls. This indicates a stage of the game. The numbers corresponding to the already shot balls (history of the game), i.e. "18", "9", "28", . . . are displayed at an upper part of the screen. The number of the shot balls is counted by the machine unit 1. The operation/display controller 11 may receive the counted value from the machine 1 or count the number each time it receives the selected sign. Further, the squares including numbers corresponding with the selected signs are displayed on the bingo card distinguishably from the other squares so that the player can easily see. For example, these squares are displayed with a different color or a different brightness, displayed on and off, or displayed with special marks.

At the bottom of the display screen, there are displayed indicators which indicate that the arrow marks can be operated until the n-th (in this example, n=4, 5, 6 and 7) ball. A selected indicator is displayed, for example, with a different color or a different brightness, or displayed on and off so as to be distinguishable from the other indicators. The operation/display controller 11 erases the arrow marks from the screen image upon the lapse of an operable period (after the n-th ball is shot), thereby clearly informing the player that he cannot change the arrangement of numbers any more. The number of obtainable tokens depends upon until which ball (n-th ball) the arrow marks are last operated. The smaller n is, the more tokens are obtainable.

At the top of the display screen, there is displayed a score, i.e. the number of obtainable tokens. The fewer balls required before one line is completed, the more tokens are paid. If the gold card is included in the completed line, two to five times as many tokens as usual are paid.

In the "Area Bingo" shown in FIG. 23, a bingo card including 5×5 squares is divided into several areas each including 3 to 6 squares by separation lines. The respective areas are displayed with different colors so that they can be easily distinguished from one another so the game is more enjoyable. The separation lines are formed by boundary lines of colors. In this embodiment, the bingo card is divided into 6 areas. A plurality of bingo cards are stored in the game ROM 12 together with area data, and a different bingo card is displayed for each game. Alternatively, at least a plurality of bingo cards or areas may be stored in the game ROM 12. For each game, the operation/display controller 11 changes at least either the bingo card or the separation lines, thereby finely changing the game.

Bet input areas for performing a betting operation are provided at the opposite lateral sides of the bingo card. The respective bet input areas are displayed with the same colors as the respective areas of the bingo card so that it can be easily grasped to which areas the bet input areas correspond. The betting operation is performed by pressing the display area having desired odds, then by pressing within a display frame "BET" by a specified number of times (1 to 20 times). The player can bet tokens corresponding to the number of times he/she pressed the display frame "BET". At the bottom corner of the display screen, the total number of bets is displayed.

As the game develops and the numbers corresponding to the balls B are judged, the squares of the bingo card including the numbers corresponding with the judged numbers are displayed in such a manner as to be distinguishable from the other squares, and the judged numbers are displayed as a history data in the bet input areas including these numbers. The newly judged number appears from the right end of the bet input area and moves to the left. This enables the player to easily see to which area the newly judged number belongs.

After 10 balls are shot, out of the areas consisting of numbers corresponding to the judged numbers, the area having a maximum sum of the judged numbers is determined to be a winning area. It is then discriminated whether the player made a bet for this winning area. The player wins if he has selected this area, and loses unless otherwise. If the player wins and the gold card is included in the winning area, he receives twice as many tokens as usual.

Basically, the lower the odds, the larger the sum of the numbers in the area. For example, the odds of the area including the numbers "4", "17" and "6" (27 in total) are one-to-twenty. On the other hand, the odds of the area including the numbers "16", "21", "10", "23", "22" and "3" (95 in total) are one-to-two.

In the "Keno" shown in FIG. 24, a bingo card including 5×5 squares is displayed. The player can participate in the game by selecting and pressing 1 to 10 squares including his desired numbers during a betting time. When a display frame "AUTO SELECT" at the bottom of the display screen is pressed, five numbers are automatically selected. Each time this frame is pressed, five different numbers are selected. The squares including the selected numbers are displayed in such a manner as to be distinguishable from the other squares.

The odds increase twofold if "BONUS ODDS" is lit at the beginning of the game. The game is determined based on how many numbers correspond with the judged numbers corresponding to 10 balls. The odds are set in proportion to the number of bet tokens. In this embodiment, when the number of bet tokens is 1 to 3, the player can win if 4 numbers correspond. When the number of bet tokens is 4 to 6, the player can win if 2 numbers correspond. Further, the odds increase in proportion to the corresponded numbers.

At the top of the display screen, the numbers of the successively selected balls are displayed as a history data, and the latest number appears from the right end and moves to the left. At the end, 10 numbers can be displayed in a row. If the gold ball is included in the shot balls, the odds are increased similar to the "Area Bingo".

In the respective game, an exemplary message "n-th ball is being shot" which indicates that the game is being played is displayed. Upon the completion of the game, an image indicating thereof is displayed and the number of tokens to be paid is displayed on the screen.

The game operation is described with reference to flowcharts shown in FIGS. 25 to 30.

Figure 25:
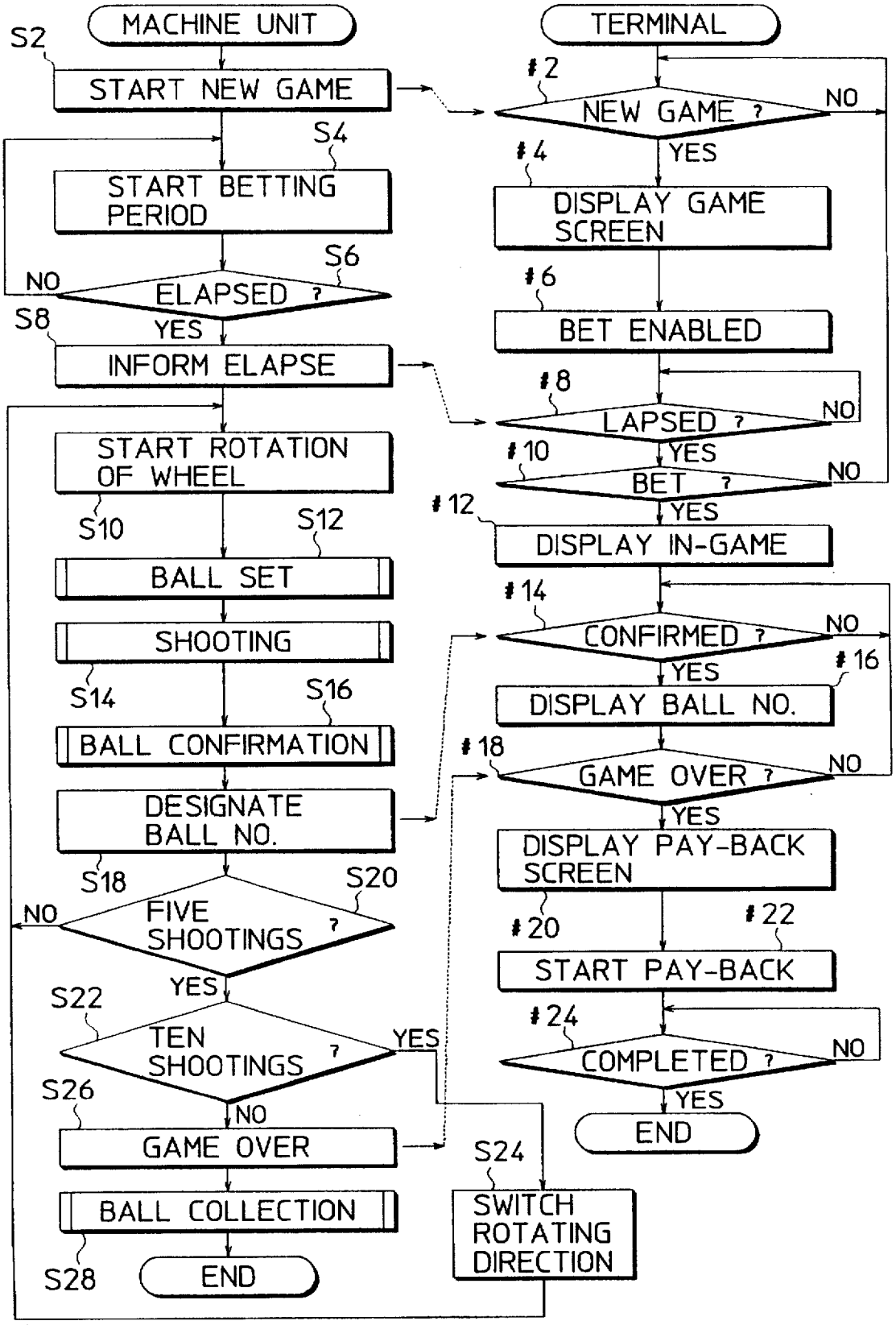
FIG. 25 is a flowchart of a main routine executed in the machine controller and the operation/display controller.

FIG. 25 is a flowchart showing a main routine of both the machine controller 1*a* and the operation/display controller 11.

First, an instruction is given to start a new game (Step S2). More specifically, the machine unit 1 repeatedly performs a sequence of operations in a specified cycle independently of whether the betting has been made in the game terminals, and sends the start information to the game terminals at the beginning of each cycle. After the start of the game is instructed, a measurement of a specified betting period is started (Step S4). Upon the lapse of the betting period (YES in Step S6), the machine controller 1*a* informs the game terminals that the betting period has elapsed (Step S8).

Upon the receipt of a new game start information, the terminals judge that a new game has been started (Step #2) and display a game screen image upon confirming the insertion of a token (Step #4). The first game screen image is the game select screen image. One game is selected out of three games when the player presses the corresponding position on the touch panel 101*d*, and the terminal a state where the bet can be made (Step #6). In this state, the player is allowed to participate in the game if he makes a desired bet for the selected game within the betting period (NO in Step #8). Upon the lapse of the betting period (YES in Step #8), it is discriminated whether any bet was made (Step #10). If the bet was made (YES in Step #10), the screen image changes to a message image indicating that the game is being played (Step #12). On the other hand, if no bet was made during the betting period, the player is judged to be not participating in the present game, and this routine returns to Step #2 to wait for a next game.

In the machine unit 1, upon the lapse of the betting period, the rotation of the rotary wheel 2 to the left is started (Step S10). Then, a subroutine "Ball Set" is carried out in which one ball B is set in the shooting devices 7 (Step S12), and a subroutine "Shooting" is carried out in which the ball B is shot (Step S14). When the shot ball B is caught by one of the ball containers 20, a subroutine "Ball Confirmation" is carried out to confirm which ball container 20 has caught the shot ball B (Step S16). During the ball confirmation, the special sign of the ball container 20 is detected as a ball number, and a ball number is designated (Step S18). In other words, the special sign is sent to the terminals as a selected ball number information.

In the terminal equipments, upon the confirmation of the received ball number (YES in Step #14), a display processing is carried out to display the ball number as shown in FIGS. 22 to 24 (Step #16).

Subsequently, in the machine unit 1, it is discriminated whether the first five balls have already been shot (Step S20). Unless the first five balls have already been shot, this routine returns to Step S10 to repeat the operations described above. If the first five balls have already been shot, it is discriminated whether the shooting has been performed both from the right and from the left, i.e. whether 10 balls have already been shot (Step #22). If 10 balls have already been shot, this routine proceeds to Step S26. On the other hand, if the balls have been shot only from one side, the remaining five balls are shot. More specifically, the rotating direction of the rotary wheel 2 and the operations of the supply device and the shooting devices 7 are switched (Step S24). Then, the rotation of the rotary wheel 2 to the right is started (Step S10), and the operations of Steps S12 to S20 are repeated. After shooting 10 balls (YES in Step S22), this routine proceeds to Step S26 in which a game completion processing is instructed. After sending the game completion information to the terminals, a subroutine "Ball Collection" is carried out (Step S28) and this routine ends.

In the terminals, upon the receipt of the game completion information, a payment screen image according to the game result is displayed (Step #20) upon the judgment that the game was completed (YES in Step #18). If the player has lost, only a message representing it is displayed. On the other hand, if the player has won, a specified number of tokens are paid through the token payment device 15 (Step #22). After confirming that the tokens have been paid to the winner, the routine ends.

Figure 26:
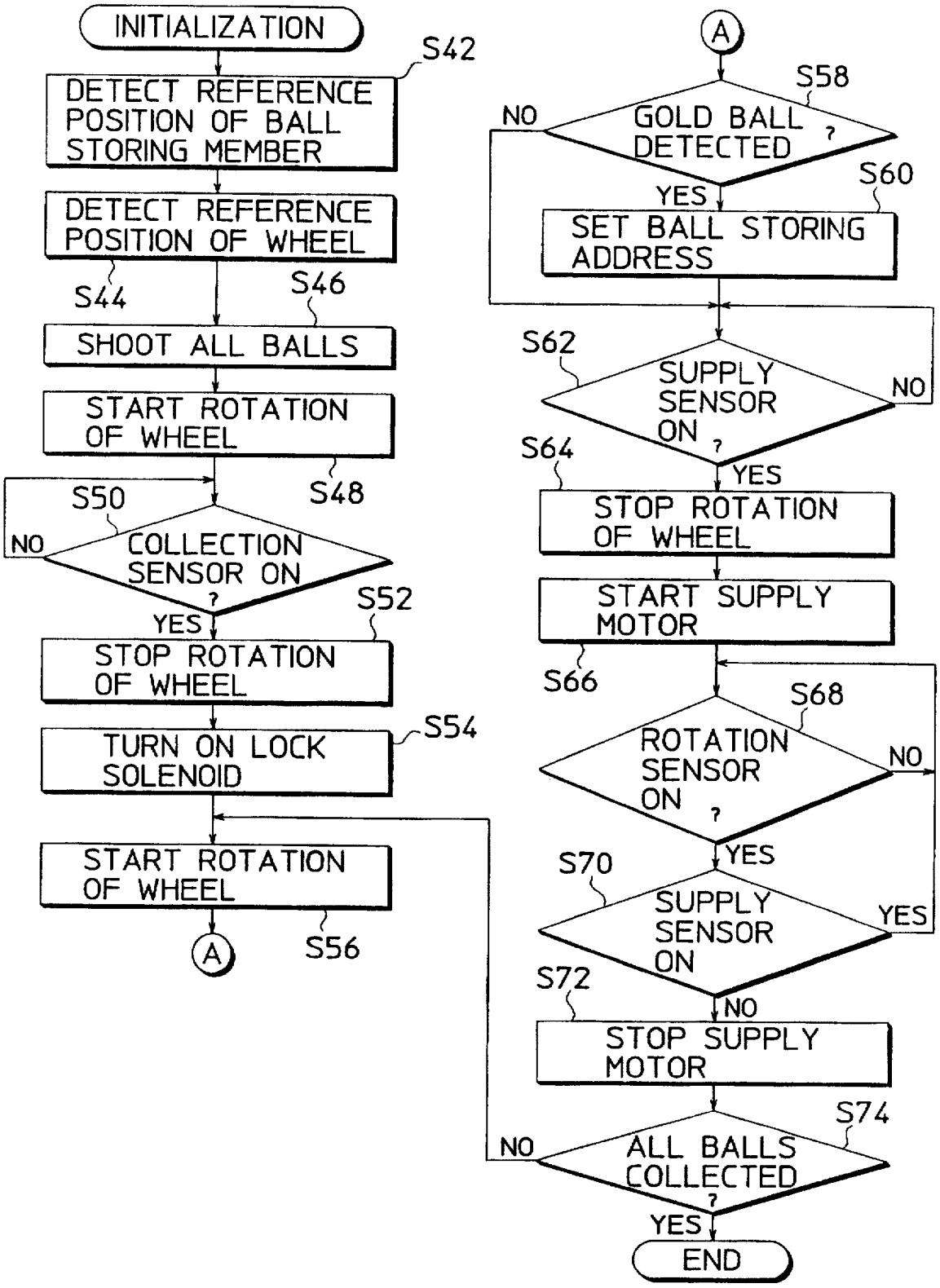
FIG. 26 is a flowchart of a subroutine "Initialization"

FIG. 26 is a flowchart showing a subroutine "Initialization".

This subroutine is called when a main power supply is turned on and is particularly carried out to confirm the position of the rotary wheel 2 and addresses in which the balls B are stored.

First, after the reference rotational position of the ball storing member 61 of the supply device 6 is detected (Step S42), the reference rotational position of the rotary wheel 2 is detected (Step S44). In this way, the rotational position of the reference ball container 20 having the detecting member 28 is traceable. Subsequently, the balls B are supplied one by one from the supply device 6 to the shooting devices 7 and all balls B are shot (Step S46). Upon the completion of shooting, the rotation of the rotary wheel 2 to the right is started (Step S48). When the collection timing sensor 55 is turned on (YES in Step S50), the rotation of the rotary wheel 2 is stopped (Step S52) upon the judgment that the ball container 20 faces the collection path 57. Then, after the lock solenoid 54 is turned on (Step S54) to lock the pivotal arm 52, the rotation of the rotary wheel 2 to the left is started (Step S56). Accordingly, the balls are collected from the ball containers 20 by the collecting mechanism 5. Whether or not the ball B being collected is the gold ball is discriminated by the gold ball sensor 58 while the balls B are passing through the collection path 57 (Step S58). If the ball B is discriminated to be the gold ball, an address of the ball storing member 61 of the supply device 6 in which the gold ball is stored is set (stored) (Step S60). This storage address is specified by the reference position sensor 66 and the rotation sensor 65. If the ball B is not the gold ball, this subroutine proceeds to Step S62, skipping Step S60. In Step S62, it is discriminated by the ball supply sensor 62 whether the ball B has been securely stored in a storage place.

Upon confirming the storage of the ball B, the rotation of the rotary wheel 2 to the left is stopped (Step S64) and the rotation of the supply motor 63 is started (Step S66). Then, the rotation sensor 65 detects a 36 degrees rotation of the ball storing member 61, i.e. the ball storing member 61 is rotated by one storing portion (YES in Step S68). If the ball supply sensor 62 detects that the ball B is already stored in this position (YES in Step S70), the ball storing member 61 is rotated to a next storing portion. If the storing portion is empty (NO in Step S70), the rotation of the supply motor 63 is stopped to store the ball therein (Step S72). It is then discriminated whether all balls B have been stored (Step S74). Unless all balls B have been stored (NO in Step S74), this subroutine returns to Step S56 to repeat the operations mentioned above. Upon confirming that all 10 balls have been collected and stored, this subroutine ends. For example, whether or not all balls have been collected is discriminated based on whether or not the detection in Step S62 has been made 10 times.

Figure 27:
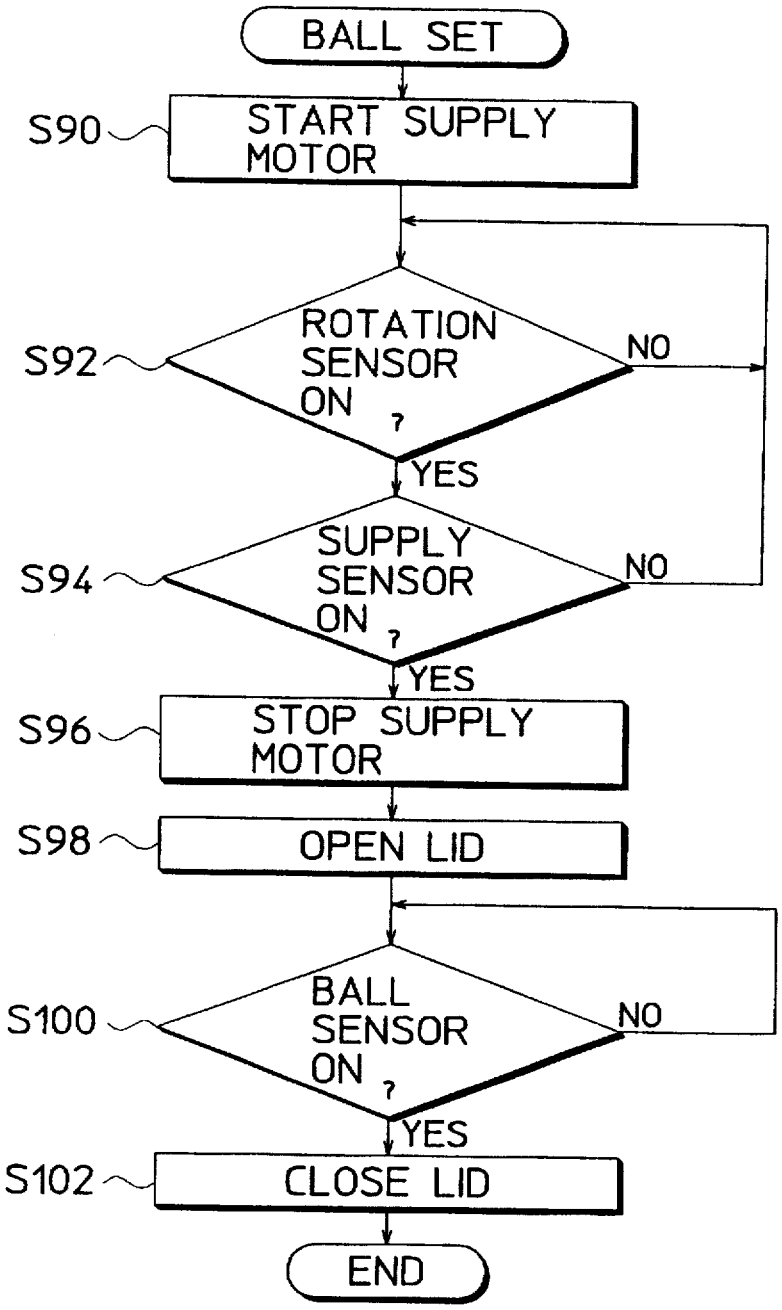
FIG. 27 is a flowchart of a subroutine "Ball Set"

FIG. 27 is a flowchart showing the subroutine "Ball Set" in FIG. 25.

First, the rotation of the supply motor 63 is started (Step S90) and the rotation sensor 65 detects whether the ball storing member 61 has been rotated by 36 degrees (Step S92). More specifically, if the next ball storing portion faces the ball outlet 603, the ball supply sensor 62 detects whether the ball B exists in this ball storing portion (Step S94).

Through these detections, the ball storing portions storing the balls B are successively caused to face the ball outlet 603. The rotation of the supply motor 63 is stopped where the ball storing portion faces the ball outlet 603 (Step S96). Subsequently, the solenoid 68 is turned on to open the lid 672 (Step S98), with the result that one ball B is discharged. Then, the ball sensor 78 detects whether the ball B is set in the hitting position (Step S100). Upon confirming that the ball B is set in the hitting position, the solenoid 68 is turned off to close the lid 672 (Step S102) and this subroutine ends.

Figure 28:
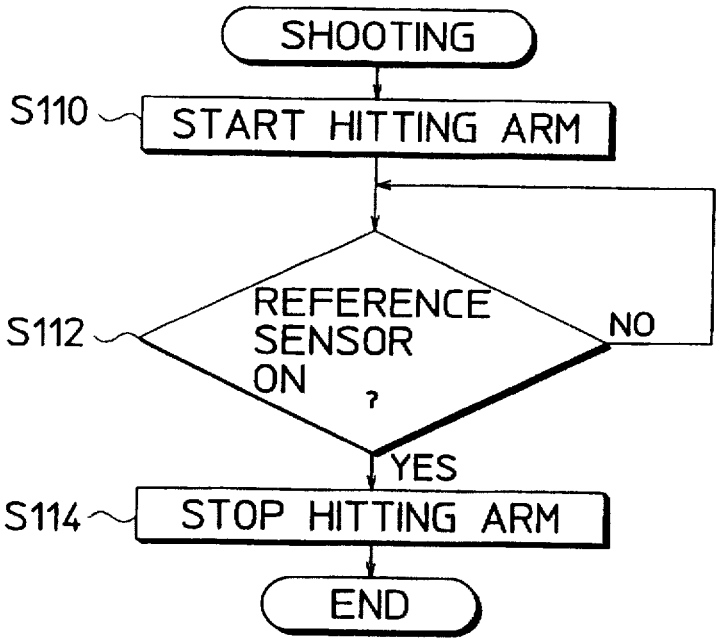
FIG. 28 is a flowchart of a subroutine "Shooting"

FIG. 28 is a flowchart showing the subroutine "Shooting" in FIG. 25.

First, the rotation of the hitting arm 74 is started (Step S110) and it is then discriminated whether the reference position sensor 79 is on (Step S112). More specifically, the motor 76 is driven to rotate the hitting arm 74 from its reference position. When the reference position sensor 79 detects the contact portion 771 of the driving force transmitting member 77 after the hitting arm 74 makes about one turn, the rotation of the motor 76 is stopped (Step S114) upon the judgment that the hitting operation was completed and the hitting arm 74 returned to its initial position.

Figure 29:
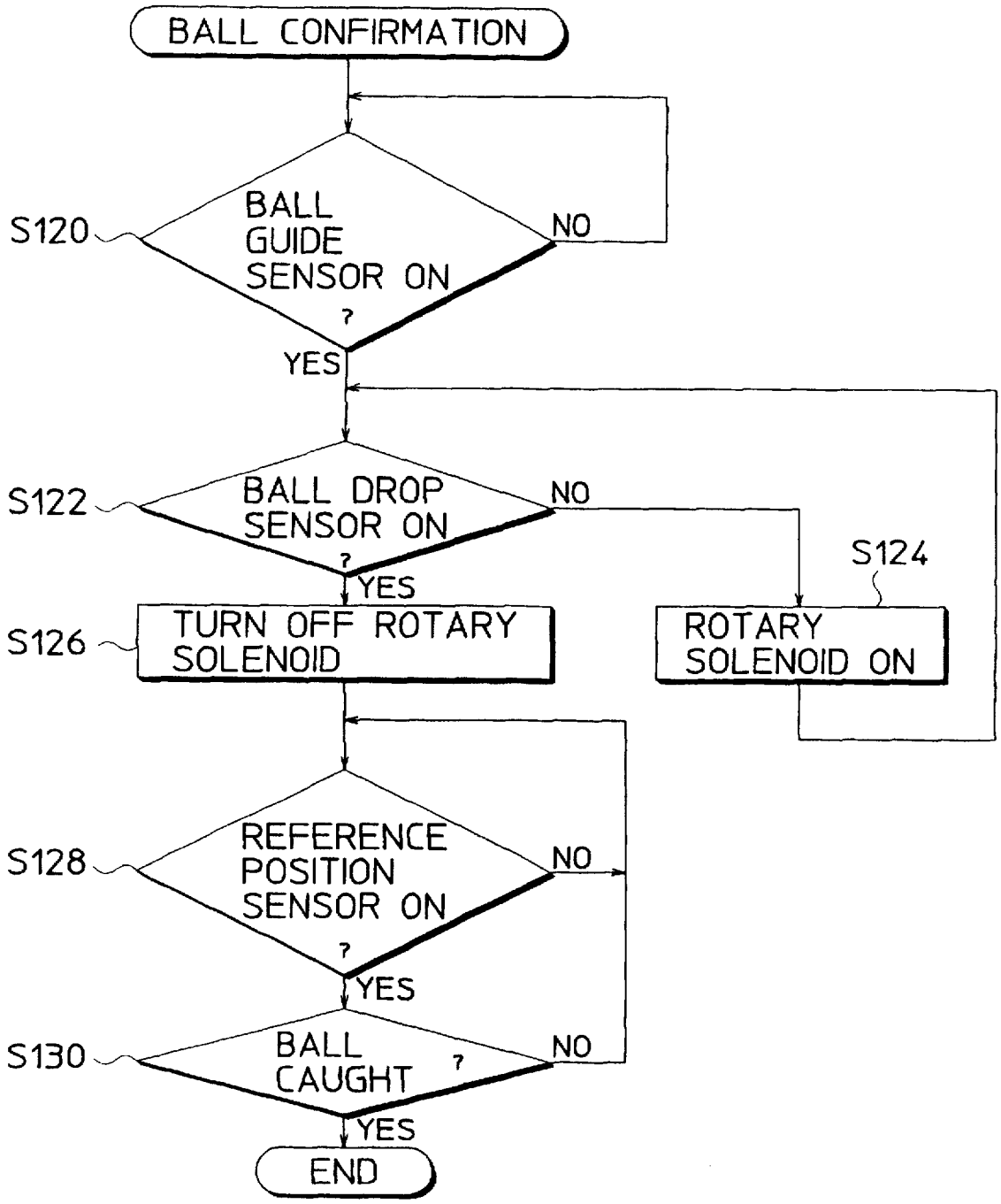
FIG. 29 is a flowchart of a subroutine "Ball confirmation"

FIG. 29 is a flowchart showing the subroutine "Ball Confirmation" in FIG. 25.

First, it is discriminated whether the ball guide sensor 814 is on (Step S120). If the ball guide sensor 814 is off, this subroutine waits on standby until the ball sensor 814 is turned on. When the ball guide sensor 814 is turned on, it is discriminated whether a ball drop sensor 804 is on (Step S122). If the ball drop sensor 804 is off despite the fact that the ball guide sensor 814 is on, it is judged that the ball B is stuck in the guide device 8 and the rotary solenoid 815 is turned on to rotate the allocating plate 817 (Step S124).

If the ball drop sensor 804 is turned on, it is judged that the ball B passed the allocating plate 817 and the rotary solenoid 815 is turned off (Step S126), with the result that the allocating plate 817 returns to its initial position. Subsequently, it is discriminated whether the reference position sensor 96 is on (Step S128). If the sensor 96 is on, the ball sensors 95 discriminate which ball container 20 caught the ball B (Step S130). In other words, the ball B dropped from the guide device 8 is going to be caught by one of the ball containers 20. The ball container 20 which caught the ball B is specified based on its position with respect to the reference ball container 20 of the rotary wheel 2. When the ball container 20 is specified, the special sign peculiar to the specified ball container 20 is obtained and is sent to the terminals as a ball number. Since the initialization makes it possible to trace the position of the reference ball container 20 of the rotary wheel 2, if this trace information is used, Step S128 may be deleted.

Figure 30:
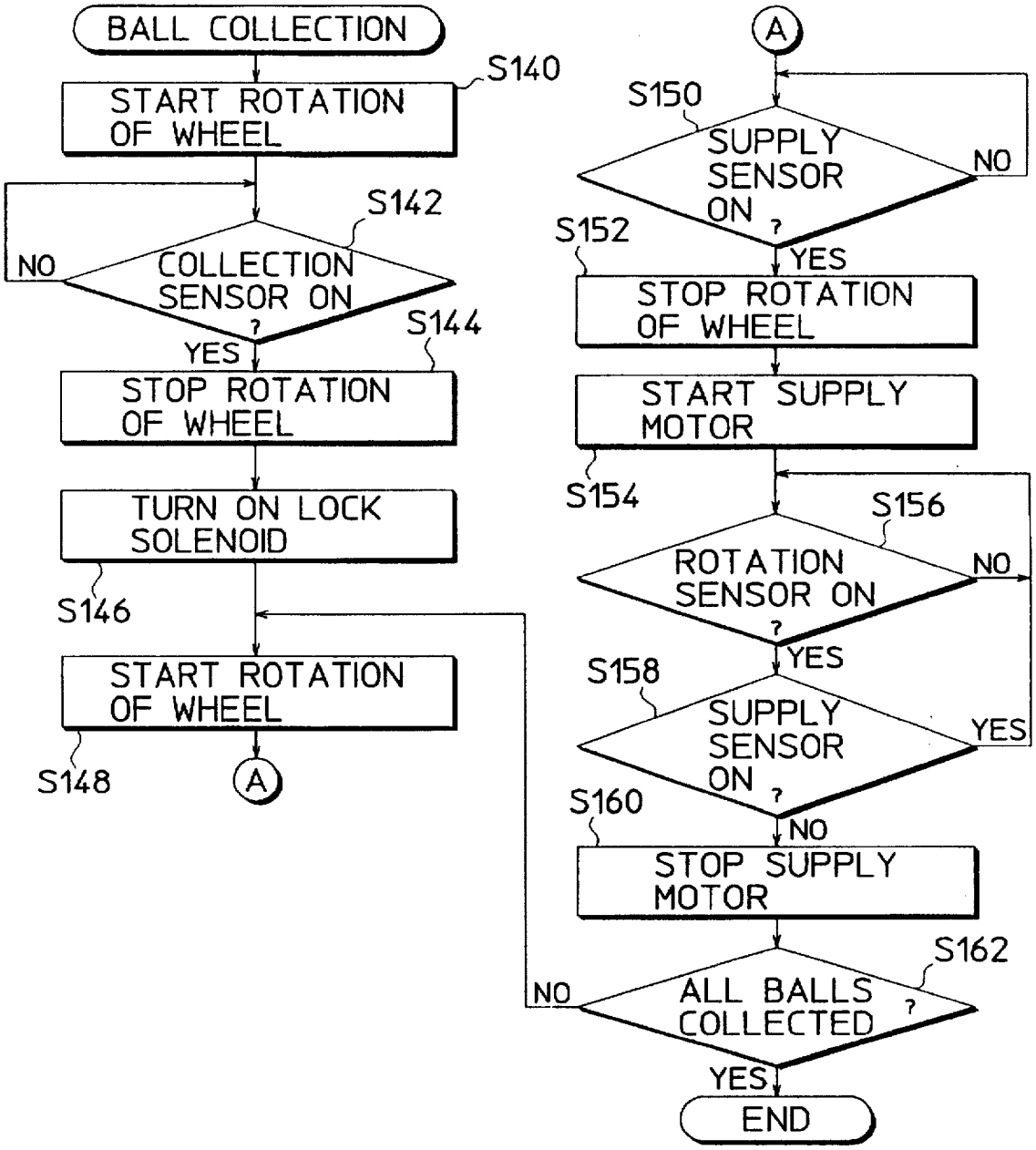
FIG. 30 is a flowchart of a subroutine "Ball Collection".

FIG. 30 is a flowchart showing the subroutine "Ball Collection" in FIG. 25.

First, when the rotation of the rotary wheel 2 to the right is started (Step S140) and the collection timing sensor 55 is turned on (YES in Step S142), the rotation of the rotary wheel 2 is stopped upon the judgment that the ball container 20 faces the collection path 57 (Step S144). Then, after the lock solenoid 54 is turned on (Step S146) to lock the pivotal arm 52, the rotation of the rotary wheel 2 to the left is started (Steps S148). Thus, the ball B is transferred from the ball container 20 to the collecting mechanism 5 and the ball sensor 62 detects that the ball B is securely stored in the storing portion (Step S150).

Upon confirming the storage of the ball B, the rotation of the rotary wheel 2 is stopped (Step S152) and the supply motor 63 is started (Step S154). Then, the rotation sensor 65 detects that the ball storing member 61 has been rotated by 36 degrees, i.e. by one storing portion (YES in Step S156). If the ball supply sensor 62 detects that the ball B is already stored in this storing portion (YES in Step S158), the ball storing member 61 is rotated to the next storing portion. If the next storing portion is empty (NO in Step S158), the supply motor is stopped (Step S160) and the ball B is stored. Subsequently, it is discriminated whether all balls B have been collected (Step S162). Unless otherwise, this subroutine returns to Step S148 to perform the above operations. Upon confirming that all 10 balls have been collected and stored, this subroutine ends.

The invention may take the following changes and modifications.

(1) It is not particularly necessary to adopt the gold ball. The magnetic sensor can be dispensed with if the gold ball is not adopted. The detection of the gold ball may be made by other than the magnetic device. For example, the gold ball may have a different color or a different weight from the other balls. In such cases, it may be discriminated by a color sensor or a load sensor.

(2) Although spherical balls are adopted as falling members in the foregoing embodiment, the falling members are not limited to balls. Members of any shape such as disk-like members, polygonal members, or flat members may be adopted. It is preferable that all the falling members have the same shape, but they may have different shapes provided that a desired randomness can be obtained.

(3) The fixed disk 3 may be rotatable together with the rotary wheel 2. With this arrangement, the mechanism for coupling the support 9 and the fixed disk 3 can be omitted, thereby simplifying the construction of the game machine.

(4) Although 10 balls are used in the foregoing embodiment, the number of the balls is not limited to this. A desired number of balls can be used according to the game content and the number of squares of the bingo card (generally, a square of a natural number). Further, although the first 5 balls and the remaining 5 balls are separately fed to the front and the rear sides in the guide device 8 in the foregoing embodiment, all balls may be driven away from an intermediate position so that the guide device 8 is allowed to have a simpler construction.

(5) Although the first 5 balls and the remaining 5 balls are shot by the different shooting devices 7 in the foregoing embodiment, they may be shot to the left and to the right by a single shooting device so that the game machine is allowed to have a simpler construction. In such a case, it is appropriate to supply the balls to the shooting device from a position right above the shooting device, to symmetrically arrange ball guides on the opposite lateral sides of the shooting device, and to make the hitting arm rotatable in both directions.

(6) The shooting operation may be performed not by the rotatable hitting arm, but by a reciprocating movement of, e.g. a plunger of a solenoid. Specifically, the ball may be pushed by the leading end of the plunger. This simplifies the construction of the shooting device.

(7) Instead of the method for storing the collected balls in 10 circumferentially arranged storing portions, the balls may be stored in one or two lines in a cylindrical container and supplied one by one from the bottom (or top) of the container, or from one of the lines by being pushed by a push-bar, etc.

(8) Although three different kinds of games can be selectively played in the foregoing embodiment, the invention is applicable to a variety of bingo games provided that a special bingo card is used.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A bingo game machine, in which a plurality of randomly selected special signs are compared with signs on a bingo card and a winner of a game is decided in accordance with correspondence of the randomly selected signs with the signs on the bingo card, comprising:

a display unit for displaying a bingo card image including squares arranged in a matrix and for allotting signs to each of said squares such that no two of said squares have the same sign, said signs allotted to said squares being included in a pool of signs from which said randomly selected special signs are selected; and a changer for changing the allotment of said signs in said squares of the bingo card image in a single operation by shifting signs from one square of said squares to another square of said squares.

2. A bingo game machine according to claim 1, wherein the changer includes:

a shifting device for said shifting of said signs which shifts signs allotted in the squares of at least one column or one row of the bingo card image one square in a predetermined direction in said at least one column or one row; and said changer further comprising an allotting device for allotting signs different from the signs remaining in said squares after said shifting to ones of said squares left without a sign due to said shifting.

3. A bingo game machine according to claim 2, wherein the allotting device allots the signs shifted out of said at least one row or column in the shifting to said ones of said squares left without a sign due to said shifting.

4. A bingo game machine according to claim 2, wherein the shifting device is operable during successive selections of said randomly selected special signs until a specified number of said randomly selected special signs are selected at which time said shifting device is disabled.

5. A bingo game machine according to claim 2, wherein the shifting device includes:

a mark displaying device which displays a shift designation mark on the display unit; and a touch sensor provided on the display unit corresponding in position with the shift designation mark for initiating said shifting in accordance with a player's touch.

6. A bingo game machine according to claim 1, wherein the changer includes:

a memory which stores at least one of a plurality of sign allotting patterns for allotting signs in the squares of the bingo card image or a plurality of separating patterns for separating the squares of the bingo card image into two or more separation areas; and a changing device which changes at least one of the sign allotting pattern or the separating pattern for each game.

7. A bingo game machine according to claim 6, wherein the separation areas are defined on the display unit by different colors.

8. A bingo game machine according to claim 1, wherein the changer includes:

a first changer device having:

a shifting device for said shifting of said signs which shifts signs allotted in the squares of at least one column or one row of the bingo card image one square in a predetermined direction in said at least one column or one row; and an allotting device for allotting signs different from the signs remaining in said squares after said shifting to ones of said squares left without a sign due to said shifting;

a second changer device having:

a memory which stores at least one of a plurality of sign allotting patterns for allotting signs in the squares of the bingo card image or a plurality of separating patterns for separating the squares of the bingo card image into two or more separation areas; and a changing device which changes at least one of the sign allotting pattern or the separating pattern for each game; and a selector for selecting between the first changer device and the second changer device.

9. A bingo game machine, in which a plurality of randomly selected special signs are compared with signs on a bingo card and a winner of a game is decided in accordance with correspondence of the randomly selected signs with the signs on the bingo card, comprising:

a display unit for displaying a bingo card image, including squares arranged in a matrix, and for allotting signs to each of said squares such that no two of said squares have the same sign, said signs allotted to said squares being included in a pool of signs from which said randomly selected special signs are selected;

a changer which changes the sign in a predetermined square of the bingo card image;

a counter which counts the number of said special signs selected up to a current time; and a count value displaying device which displays a value counted by the counter.

10. A bingo machine comprising:

bingo number means for successively randomly selecting call-out numbers from a pool of numbers;

at least one player terminal including a display and an input means for receiving player input;

image generating means for generating a bingo card image on said display, said bingo card image being a matrix of squares arranged in rows and columns;

allotting means for allotting numbers included in said pool of numbers randomly to said squares prior to a start of a bingo game, the start of the bingo game being defined by said bingo number means selecting a first call-out number; and shifting means, responsive to said input means, for shifting said allotted numbers between squares in a selected one of one of said rows and said columns following said start of said bingo game.

11. The bingo machine according to claim 10 wherein a total number of said numbers in said pool of numbers equals a total number of said squares of said bingo card.

12. The bingo machine according to claim 10 further comprising:

counter means for counting a total number of said call-out numbers currently selected by said bingo number means; and limiting means for disabling said shifting means when said total number of said call-out numbers reaches a predetermined limit.

13. The bingo machine according to claim 12 further comprising:

said input means including means for permitting a player to place a bet; and bet pay-off calculating means for calculating a bet pay-off based on correspondence of said call-out numbers to said allotted numbers and said total number of said call-out numbers existing at a last occurrence of a shifting operation by said shifting means, wherein said bet pay-off is decreased in accordance with a lateness of said last occurrence of a shifting operation by said shifting means.

14. The bingo machine according to claim 10 further comprising:

said input means including means for permitting a player to place a bet;

counter means for counting a total number of said call-out numbers currently selected by said bingo number means; and bet pay-off calculating means for calculating a bet pay-off based on correspondence of said call-out numbers to said allotted numbers and said total number of said call-out numbers existing at a last occurrence of a shifting operation by said shifting means, wherein said bet pay-off is decreased in accordance with a lateness of said last occurrence of a shifting operation by said shifting means.

15. The bingo machine according to claim 10 wherein said shifting means shifts said allotted numbers, of said selected one of said one of said rows and said columns, a predetermined number of squares resulting in a number of said allotted numbers equal to said predetermined number of squares being erased by shifting out of one end of said selected one of said one of said rows and said columns and the erased allotted numbers being reintroduced by shifting into another end of said selected one of said one of said rows and said columns.

* * * * *